US007703294B2

(12) United States Patent
Nakamura

(10) Patent No.: US 7,703,294 B2
(45) Date of Patent: Apr. 27, 2010

(54) INDOOR UNIT OF AN AIR CONDITIONER

(75) Inventor: Junji Nakamura, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 879 days.

(21) Appl. No.: 10/549,194

(22) PCT Filed: Mar. 23, 2004

(86) PCT No.: PCT/JP2004/003979

§ 371 (c)(1),
(2), (4) Date: Sep. 16, 2005

(87) PCT Pub. No.: WO2004/085929

PCT Pub. Date: Oct. 7, 2004

(65) Prior Publication Data

US 2006/0218957 A1 Oct. 5, 2006

(30) Foreign Application Priority Data

Mar. 26, 2003 (JP) ..... 2003-085382
Aug. 29, 2003 (JP) ..... 2003-307094

(51) Int. Cl.
*F25D 23/12* (2006.01)

(52) U.S. Cl. ..... 62/262

(58) Field of Classification Search ..... 62/262, 62/298, 317, 327, 419
See application file for complete search history.

(56) References Cited

U.S. PATENT DOCUMENTS

| | | | | |
|---|---|---|---|---|
| 3,354,809 | A | 11/1967 | Orr et al. | |
| 4,586,349 | A * | 5/1986 | Ohishi | 62/296 |
| 5,782,688 | A * | 7/1998 | Baek et al. | 454/233 |
| 5,787,717 | A | 8/1998 | Bang | |
| 5,807,170 | A | 9/1998 | Lee | |
| 6,725,684 | B2 * | 4/2004 | Lee et al. | 62/298 |
| 6,729,154 | B2 * | 5/2004 | Takashima et al. | 62/317 |
| 2005/0097915 | A1 | 5/2005 | Joo et al. | |

FOREIGN PATENT DOCUMENTS

| | | | |
|---|---|---|---|
| AU | 115731 | S | 11/1992 |
| AU | 150886 | S | 2/2003 |
| CN | 2415297 | Y | 1/2001 |
| CN | 1346955 | A | 5/2002 |
| EP | 1 092 927 | A2 | 4/2001 |
| EP | 1 321 724 | A1 | 6/2003 |
| GB | 1147282 | | 4/1969 |
| JP | 60-74670 | U | 5/1985 |
| JP | 63-22545 | U | 2/1988 |
| JP | 03-06232 | U | 1/1991 |
| JP | 04-20923 | | 2/1992 |
| JP | 05-007695 | A | 1/1993 |
| JP | 07-098129 | A | 4/1995 |

(Continued)

*Primary Examiner*—Melvin Jones
(74) *Attorney, Agent, or Firm*—Global IP Counselors

(57) ABSTRACT

An air conditioner indoor unit has a casing main body and a front panel. The casing main body has an outlet for passing air out into a room. The front panel covers the outlet as seen in a front surface view. Furthermore, the front panel opens and closes the outlet. In addition, the front panel has a projection area greater than the outlet as seen in a front view when the outlet is closed.

14 Claims, 14 Drawing Sheets

FOREIGN PATENT DOCUMENTS

| | | | |
|---|---|---|---|
| JP | 2000-39171 | | 2/2000 |
| JP | 2000-121094 | A | 4/2000 |
| JP | 2000-234760 | A | 8/2000 |
| JP | 2001-065907 | A | 3/2001 |
| JP | 2001-146861 | A | 5/2001 |
| JP | 2001-182957 | A | 7/2001 |
| JP | 2001-201098 | A | 7/2001 |
| JP | 3334688 | | 8/2002 |
| JP | 2002-295888 | A | 10/2002 |
| JP | 2003-074962 | A | 3/2003 |
| JP | 2003-083566 | A | 3/2003 |
| KR | 2000-0056584 | | 9/2000 |
| KR | 2002-0082391 | A | 10/2002 |

* cited by examiner

B–B

C–C

E–E

INDOOR UNIT OF AN AIR CONDITIONER

CROSS-REFERENCE TO RELATED APPLICATIONS

This nonprovisional application claims priority under 35 U.S.C. §119(a) to Japanese Patent Application Nos. 2003-085382, filed in Japan on Mar. 26, 2004 and 2003-307094, filed in Japan on Aug. 29, 2003, the entire contents of which are hereby incorporated by reference.

FIELD OF THE INVENTION

The present invention relates to an indoor unit of an air conditioner.

RELATED ART

Air conditioner indoor units that air condition rooms have been frequently used in recent years. This indoor unit is often within the visual field of the occupants and the like because it is disposed indoors. Consequently, it is important that the indoor unit does not impair the aesthetics of the room. However, a casing of the indoor unit is usually provided with an outlet through which passes the air blown out into the room. The indoor unit air conditions the room by blowing out conditioned air from the outlet into the room. This outlet is often provided at the front of the casing of the indoor unit, and is therefore easily visible to the occupants and the like in the room. Accordingly, there is a risk of disrupting the harmony between the external appearance of the indoor unit, the wall surfaces and the like of the room, and there is a risk of impairing the aesthetics of the room.

On the other hand, a conventional air conditioner indoor unit as described above is often provided with a horizontal flap that opens and closes the outlet (refer to the specification in U.S. Pat. No. 3,334,688). This horizontal flap opens the outlet during operation of the indoor unit, and guides the air blown out from the outlet. Furthermore, the horizontal flap closes the outlet when operation of the indoor unit is stopped. This prevents the outlet from entering the visual field of the occupants and the like when operation of the indoor unit is stopped, and reduces the risk of impairing the aesthetics of the room.

However, there is still a risk with the above type of air conditioner indoor unit that the aesthetics of the room will be impaired. Namely, even if a horizontal flap 201 closes an outlet 202 as in an indoor unit 200 depicted in FIG. 11, it is often the case that a seam appears between the horizontal flap 201 and the outlet 202 in a front view.

With such an indoor unit, there is a risk of impairing the aesthetics of the room.

DISCLOSURE OF THE INVENTION

It is an object of the present invention to provide an air conditioner indoor unit that can reduce the risk of impairing the aesthetics of a room.

An indoor unit of an air conditioner according to a first aspect of the present invention has a casing and a front panel. The casing has an outlet through which passes air blown out into a room. The front panel covers the outlet in a front view, and opens and closes the outlet. In addition, in a state wherein the outlet is closed, the front panel has a projection area greater than the outlet as seen in a front surface view.

With this air conditioner indoor unit, the front panel that opens and closes the outlet has a projection area greater than the outlet in a front view. Consequently, the front panel can hide the outlet. This accordingly reduces the risk that a seam between the front panel and the outlet will appear in the indoor unit in a front view. Thereby, with this air conditioner indoor unit, the risk of impairing the aesthetics of the room can be further reduced.

An indoor unit of an air conditioner according to a second aspect is the indoor unit of an air conditioner as recited in the first aspect wherein the front panel has a width substantially the same as a width of the casing as seen in a front surface view.

With this air conditioner indoor unit, the front panel that opens and closes the outlet has a width substantially the same as the width of the casing, including the outlet, in a front view. Consequently, the front panel can cover the casing across the substantial entirety of the casing in the width direction. Accordingly, this air conditioner indoor unit can reduce the seams appearing in the surface of the indoor unit in a front view. Thereby, with this air conditioner indoor unit, the risk of impairing the aesthetics of the room can be further reduced.

An indoor unit of an air conditioner according to a third aspect is the indoor unit of an air conditioner as recited in the first or second aspect wherein the front panel does not have a seam extending in the longitudinal direction as seen in a front surface view.

With this air conditioner indoor unit, the front panel does not have a seam extending in the longitudinal direction in a front view. Consequently, not only does no seam appear between the front panel and the casing, but the seams appearing in the front panel itself are few. Thereby, with this air conditioner indoor unit, the risk of impairing the aesthetics of the room can be further reduced. Particularly because no seam extending in the longitudinal direction appears, the aesthetics provided to the occupants and the like in the room is further enhanced.

An indoor unit of an air conditioner according to a fourth aspect is the indoor unit of an air conditioner as recited in any one of the first through third aspects wherein the casing further comprises an inlet provided in the front surface and through which passes air taken in from the room. Further, the front panel comprises a first panel and a second panel. The first panel opens and closes the outlet, and has a projection area greater than the outlet in a front view in a state wherein the outlet is closed. The second panel opens and closes the inlet, and has a projection area greater than the inlet as seen in a front surface view in a state wherein the inlet is closed.

With a conventional air conditioner indoor unit, not only is the outlet disposed on the front surface, but the inlet is also disposed on the front surface. In this case, there is a risk that the inlet will impair the aesthetics of the room if it enters the visual field of the occupants and the like, the same as the outlet. In addition, it is conventional to provide a panel that opens and closes the inlet and to close the inlet when the operation of the air conditioner is stopped; however, the seam between the inlet and the panel appears in a front view, and there is consequently a risk of impairing the aesthetics of the room.

With this air conditioner indoor unit, the first panel has a projection area greater than the outlet in a front view in a state wherein the outlet is open. Consequently, the first panel can hide the outlet in a front view. In addition, the second panel has a projection area greater than the inlet in a front view in a state wherein the inlet is closed. Consequently, the second panel can hide the inlet in a front view. Thus, with this air conditioner indoor unit, the risk that the inlet or the outlet will impair the aesthetics of the room can be reduced.

An indoor unit of an air conditioner according to a fifth aspect is the indoor unit of an air conditioner as recited the fourth aspect wherein the first panel does not have a seam, and has a width substantially the same as the width of the casing, including the outlet, as seen in a front surface view. In addition, the second panel does not have a seam, and has a width substantially the same as the width of the casing, including the inlet, as seen in a front surface view.

With this air conditioner indoor unit, the first panel and the second panel have a width substantially the same as the width of the casing. Consequently, the first panel and the second panel can cover the casing across substantially the entirety of the casing in the width direction. In addition, the first panel and the second panel respectively have no seams. Consequently, the seams appearing in the indoor unit in a front view can be reduced. Thereby, with this air conditioner indoor unit, the risk of impairing aesthetics can be reduced.

An indoor unit of an air conditioner according to a sixth aspect is the indoor unit of an air conditioner as recited in any one of the first through third aspects wherein the casing further comprises an inlet provided on the front surface and through which passes air taken in from the room. In addition, the front panel opens and closes the outlet and the inlet, and is a seamless member that covers the outlet and the inlet of the casing as seen in a front surface view in a state wherein the outlet and the inlet are closed.

With this air conditioner indoor unit, the seamless front panel covers both the inlet and the outlet. Consequently, seams appearing in the indoor unit in a front view can be further reduced. Thereby, with this air conditioner indoor unit, the risk of impairing aesthetics can be further reduced.

An indoor unit of an air conditioner according to a seventh aspect is the indoor unit of an air conditioner as recited in the sixth aspect wherein the front panel has a width substantially the same as the width of the casing as seen in a front surface view.

With this air conditioner indoor unit, a single, seamless front panel covers the casing across the substantial entirety of the casing in the width direction. Consequently, seams appearing in the indoor unit in a front view can be further reduced. Thereby, with this air conditioner indoor unit, the risk of impairing aesthetics can be further reduced.

An indoor unit of an air conditioner according to an eighth aspect is the indoor unit of an air conditioner as recited in any one of the first through seventh aspects wherein the front panel covers substantially the entirety of the front surface of the casing as seen in a front surface view.

With this air conditioner indoor unit, the front panel covers the substantial entirety of the front surface of the casing. Consequently, with this air conditioner indoor unit, the seams appearing in the indoor unit in a front view can be further reduced. Thereby, with this air conditioner indoor unit, the risk of impairing aesthetics can be further reduced.

An indoor unit of an air conditioner according to a ninth aspect is the indoor unit of an air conditioner as recited in any one of the first through eighth aspects wherein in a state wherein the outlet is closed, the front side of the front panel is a flat surface parallel to the vertical direction.

With this air conditioner indoor unit, the front side of the front panel forms a flat surface parallel to the vertical direction in a state wherein the outlet is closed. Accordingly, with this air conditioner indoor unit, the harmony between the external appearance of the indoor unit in a front view and the side walls of the room is improved. Thereby, with this air conditioner indoor unit, the aesthetics can be further enhanced.

An indoor unit of an air conditioner according to a tenth aspect is the indoor unit of an air conditioner as recited in the fourth or fifth aspect wherein the front panel further comprises a third panel. The third panel is disposed between the first panel and the second panel, and has no seams as seen in a front surface view. Further, in a state wherein the outlet and the inlet are closed, the first panel, the second panel, and the third panel are disposed so that they constitute a substantially flat surface.

With this air conditioner indoor unit, the first panel, the second panel, and the third panel are disposed so that they constitute a substantially flat surface in a state wherein the outlet and the inlet are closed. Consequently, when the operation of the indoor unit is stopped, and the like, the substantially flat surface appears in the indoor unit, thereby enabling the aesthetics of the indoor unit to be further enhanced.

An indoor unit of an air conditioner according to an eleventh aspect is the indoor unit of an air conditioner as recited in the tenth aspect wherein the movement of the first panel to the rear of the third panel opens the outlet.

With this air conditioner indoor unit, the first panel moves to the rear of the third panel if the outlet is open. Consequently, the aesthetics of the indoor unit in a state wherein the outlet is open can be further enhanced.

An indoor unit of an air conditioner according to a twelfth aspect is the indoor unit of an air conditioner as recited in the fourth or fifth aspect wherein the movement of the second panel so that it is spaced apart from the inlet opens the inlet. Further, the movement of the first panel to between the casing and the second panel, which has moved so that it is spaced apart from the inlet, opens the outlet.

With this air conditioner indoor unit, the first panel moves between the second panel and the casing if the outlet is open. Consequently, the aesthetics of the indoor unit in a state wherein the outlet is open can be further enhanced.

An indoor unit of an air conditioner according to a thirteenth aspect is the indoor unit of an air conditioner as recited in the twelfth aspect wherein the first panel and the second panel are arrayed vertically on the front surface of the casing, with the first panel disposed on the lower side and the second panel disposed on the upper side. Further, the movement of the second panel frontward opens the inlet. In addition, the movement of the first panel upward, and the movement of the first panel to the rear of the second panel, which has moved frontward, opens the outlet.

With this air conditioner indoor unit, the first panel moves to the rear of the second panel if the outlet is open. Consequently, the aesthetics of the indoor unit in a state wherein the outlet is open can be further enhanced.

An indoor unit of an air conditioner according to a fourteenth aspect is the indoor unit of an air conditioner as recited in the thirteenth aspect wherein in a state wherein the inlet is open, the second panel enters a state wherein its upper end is inclined frontward.

With this air conditioner indoor unit, the upper end of the second panel enters a state inclined frontward in a state wherein the inlet is open. Accordingly, when the air conditioner indoor unit is viewed from below, the second panel appears relatively large, thereby making it difficult to externally see the inlet. Consequently, the aesthetics of the air conditioner indoor unit in a state wherein the inlet is open can be further enhanced.

An indoor unit of an air conditioner according to a fifteenth aspect is the indoor unit of an air conditioner as recited in the thirteenth or fourteenth aspect wherein in a state wherein the inlet is open, the lower end of the second panel is positioned upward of the outlet, which is positioned below the inlet.

With this air conditioner indoor unit, in a state wherein the inlet is open, the lower end of the second panel is positioned upward of the outlet. Consequently, there is little risk that the second panel will hinder the blow out of air.

An indoor unit of an air conditioner according to a sixteenth aspect is the indoor unit of an air conditioner as recited in any one of the twelfth through fifteenth aspects wherein when the outlet opens, the first panel moves in a state wherein it is proximate to the casing.

With this air conditioner indoor unit, the first panel moves in a state proximate to the casing when the outlet opens, and the gap between the first panel and the casing is consequently small. Accordingly, it is possible to suppress the generation of a short circuit wherein air blown out from the outlet unfortunately leaks from between the first panel and the casing.

BRIEF EXPLANATION OF DRAWINGS

FIG. 2(*b*) is a side cross sectional view of the indoor unit when operation is stopped according to the first embodiment.

FIG. 3(*b*) is a side cross sectional view during operation of the indoor unit according to the first embodiment.

FIG. 4(*b*) is a side cross sectional view of the indoor unit when operation is stopped according to the second embodiment.

FIG. 5(*b*) is a side cross sectional view during operation of the indoor unit according to the second embodiment.

FIG. 6(*b*) is a side cross sectional view during operation of the indoor unit according to the third embodiment.

FIG. 7(*b*) is a side cross sectional view of the indoor unit when operation is stopped according to the fourth embodiment.

FIG. 8(*b*) is a side cross sectional view during operation of the indoor unit according to the fourth embodiment.

FIG. 9(*b*) is a side cross sectional view during operation of the indoor unit according to another embodiment.

FIG. 9(*c*) is a side cross sectional view during operation of the indoor unit according to another embodiment.

FIG. 12(*b*) is a side cross sectional view of the indoor unit when operation is stopped according to the fifth embodiment.

PREFERRED EMBODIMENTS

First Embodiment

Air Conditioner Overall Constitution

Figure 1:
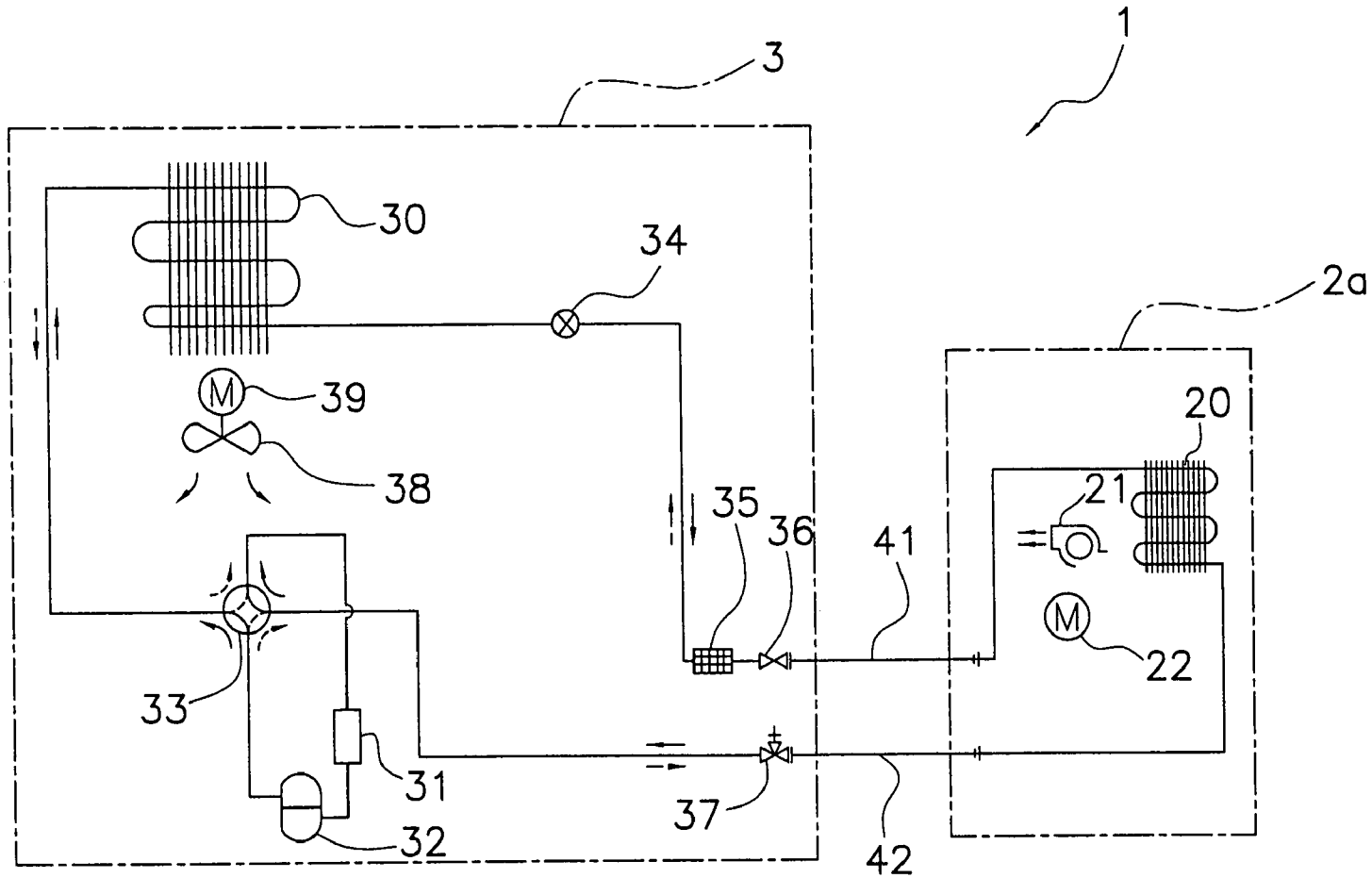
FIG. 1 depicts the constitution of the air conditioner and a refrigerant circuit according to the first embodiment.

FIG. 1 depicts the constitution of an air conditioner 1 and a schematic of the refrigerant circuit according to the first embodiment of the present invention.

This air conditioner 1 comprises an indoor unit 2*a* attached to a wall surface, and the like, of the room, and an outdoor unit 3 installed outdoors.

The refrigerant circuit of this air conditioner 1 principally comprises an indoor heat exchanger 20, an accumulator 31, a compressor 32, a four way switching valve 33, an outdoor heat exchanger 30, and a motor operated expansion valve 34.

The indoor heat exchanger 20 provided in the indoor unit 2*a* exchanges heat with the air that it contacts. In addition, the indoor unit 2*a* is provided with an indoor fan 21 that sucks in the indoor air, passes it through the indoor heat exchanger 20, exchanges its heat, and then discharges that air into the room. An indoor fan motor 22 provided inside the indoor unit 2*a* rotatably drives the indoor fan 21. The detailed constitution of the indoor unit 2*a* will be explained later.

The outdoor unit 3 comprises the compressor 32, the four way switching valve 33 connected to the discharge side of the compressor 32, the accumulator 31 connected to the inlet side of the compressor 32, the outdoor heat exchanger 30 connected to the four way switching valve 33, and the motor operated expansion valve 34 connected to the outdoor heat exchanger 30. The motor operated expansion valve 34 is connected to a piping 41 via a filter 35 and a liquid shutoff valve 36, and is connected to one end of the indoor heat exchanger 20 via this piping 41. In addition, the four way switching valve 33 is connected to a piping 42 via a gas shutoff valve 37, and is connected to the other end of the indoor heat exchanger 20 via this piping 42. In addition, the outdoor unit 3 comprises an outdoor fan 38 for externally discharging the air after its heat has been exchanged by the outdoor heat exchanger 30. An outdoor fan motor 39 rotatably drives this outdoor fan 38.

<Indoor Unit Constitution>

Figure 2:
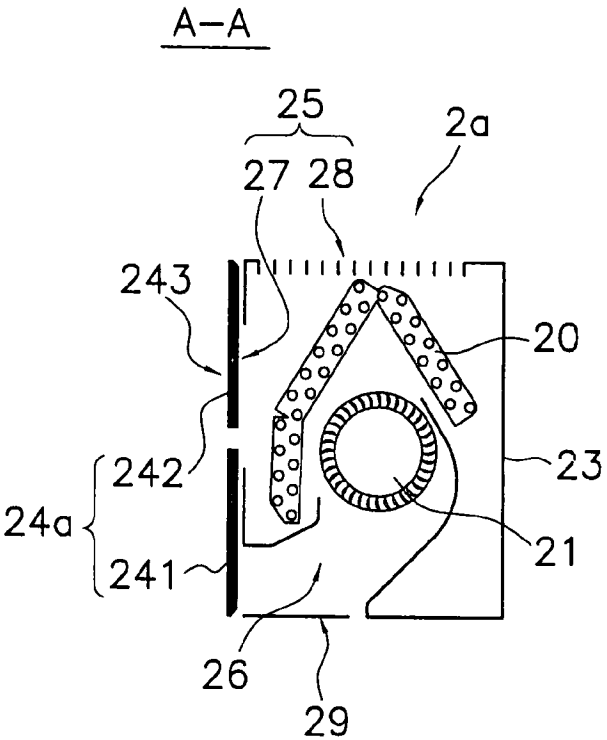
FIG. 2(*a*) is a front view of the indoor unit when operation is stopped according to the first embodiment.
Figure 2:
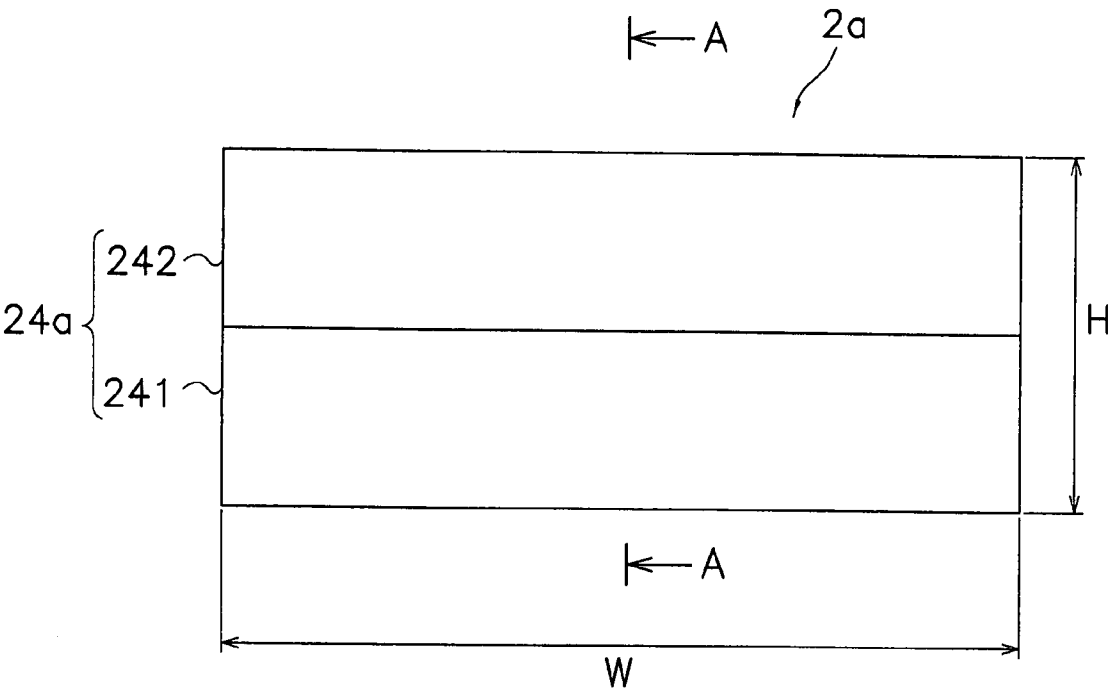

FIG. 2(*a*) is a front view of the indoor unit 2*a*, and FIG. 2(*b*) is a side cross sectional view of the indoor unit 2*a*. FIG. 2(*a*) and FIG. 2(*b*) depict the indoor unit 2*a* when operation is stopped.

The indoor unit 2*a* is a wall mounted type indoor unit provided on a side wall of a room, and comprises a casing main body 23 (casing), and a front panel 24*a*.

<Casing Main Body>

The casing main body 23 has a long rectangular shape in the horizontal direction in a front view, and has a long rectangular cross sectional shape in the vertical direction in a side view. The inside of the casing main body 23 comprises the above discussed indoor heat exchanger 20, the indoor fan 21, the indoor fan motor 22 (not shown), and the like. As depicted in FIG. 2(*b*), in a side view, the indoor fan 21 is disposed in the center of the casing main body 23, and the indoor heat exchanger 20 having an inverted V shape is disposed so that it surrounds the upper half of the indoor fan 21. In addition, the casing main body 23 comprises an inlet 25, and an outlet 26.

The inlet 25 is an opening through which passes the air taken in by the indoor fan 21 from the room into the casing main body 23, and comprises a first inlet 27 (inlet) and a second inlet 28. The first inlet 27 has a long shape in the horizontal direction in a front view, and its length is slightly less than the width W of the casing main body 23. As depicted in FIG. 2(*b*), the first inlet 27 is provided in the vicinity of the center in the front surface of the casing main body 23, opposing the front side of the indoor heat exchanger 20. The second inlet 28 comprises a plurality of long slits in the longitudinal direction of the casing main body 23, and is provided in the top surface of the casing main body 23.

Figure 3:
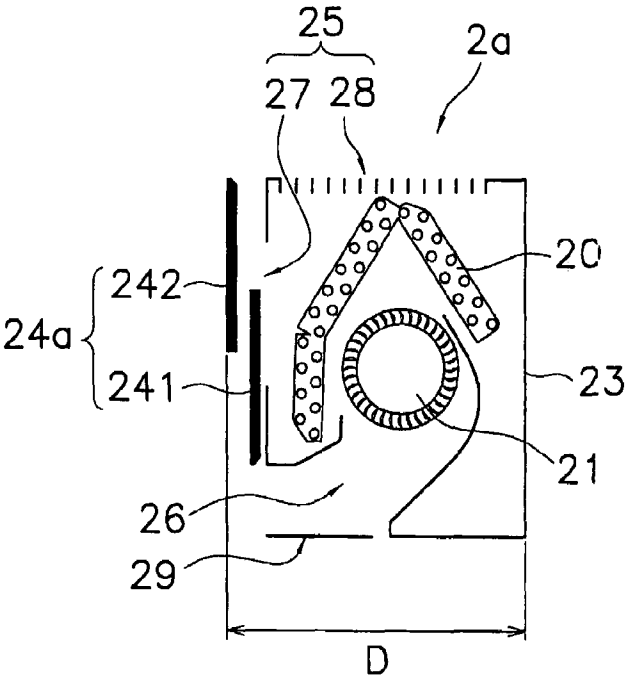
FIG. 3(*a*) is a front view during operation of the indoor unit according to the first embodiment.
Figure 3:
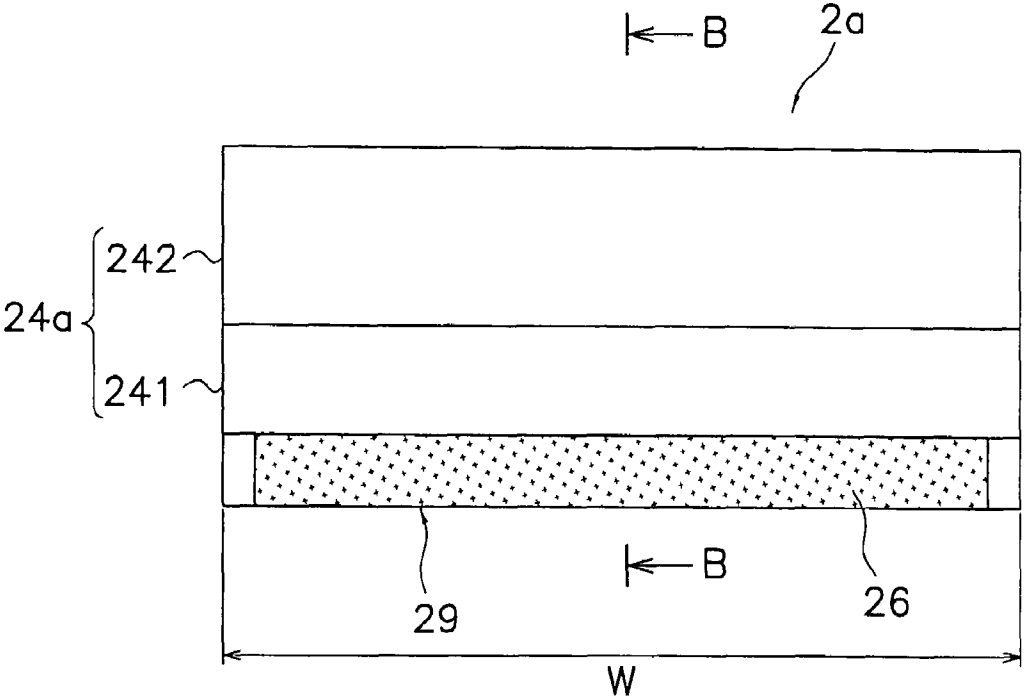

The outlet 26 is an opening through which passes the air blown out by the indoor fan 21 through the indoor heat exchanger 20 into the room. The outlet 26 has a long shape in the horizontal direction, as depicted in FIG. 3(*a*), and its length is slightly less than the width W of the casing main body 23. In addition, the outlet 26 is in the vicinity of the lower part of the casing main body 23, and is provided in the front surface of the casing main body 23. Furthermore, FIG. 3(*a*) is a front view of the indoor unit 2*a* during operation.

In addition, a horizontal flap 29 is provided in the vicinity of the outlet 26. The horizontal flap 29 is a plate shaped member having a long shape in the longitudinal direction of the indoor unit 2*a*, and guides air blown out from the outlet 26. The horizontal flap 29 has a rotational axis parallel to the longitudinal direction of the indoor unit 2*a*, and rotates about the rotational axis, thereby modifying the guide direction of the air.

<Front Panel>

The front panel 24*a* covers the outlet 26 and the first inlet 27 in a front view, and opens and closes the outlet 26 and the first inlet 27. The front panel 24*a* is a panel assembly that aggregates a seamless plurality of panels, and has a first panel 241 and a second panel 242.

The first panel 241 is disposed at the lower part of the front surface of the casing main body 23. The first panel 241 is movably supported by a moving mechanism (not shown), and opens and closes the outlet 26. The first panel 241 is a rectangular plate shaped member having no seams, whose width is substantially the same as the width W of the casing main body 23 in a front view, and whose height is approximately half a height H of the casing main body 23. In the state wherein the outlet 26 is closed, the first panel 241 is in a state parallel to the vertical direction, as depicted in FIG. 2(*b*). In addition, in this state, the first panel 241 has a projection area larger than the outlet 26 in a front view. Accordingly, in the state wherein the outlet 26 is closed, the first panel 241 covers the entire lower half of the front surface of the casing main body 23, including the outlet 26.

The second panel 242 is disposed at the upper part of the front surface of the casing main body 23. The second panel 242 is movably supported by the moving mechanism (not shown), and opens and closes the first inlet 27. The second panel 242 is a rectangular plate shaped member having no seams, the same as the first panel 241, whose width is substantially the same as the width W of the casing main body 23, including the first inlet 27 in a front view, and whose height is approximately half the height H of the casing main body 23. In a state wherein the first inlet 27 is closed, the second panel 242 is in a state parallel to the vertical direction, as depicted in FIG. 2(*b*). In addition, in this state, the second panel 242 is positioned at the upper part of and aligned with the first panel 241, and has a projection area larger than the first inlet 27 in a front view. Accordingly, in a state wherein the first inlet 27 is closed, the second panel 242 covers the entire upper half of the front surface of the casing main body 23, including the first inlet 27.

Thus, in a state wherein the outlet 26 is closed, the first panel 241 covers the entire lower half of the front surface of the casing main body 23, including the outlet 26; and in a state wherein the first inlet 27 is closed, the second panel 242 covers the entire upper half of the front surface of the casing main body 23, including the first inlet 27. In addition, the first panel 241 and the second panel 242 are arrayed vertically, without any gaps. Consequently, in a state wherein the outlet 26 and the first inlet 27 are closed, the front panel 24*a* comprising the first panel 241 and the second panel 242 is in a state that substantially completely covers the entire front surface of the indoor unit 2*a*, as depicted in FIG. 2(*a*). Accordingly, in this state, only the front panel 24*a* enters the visual field of the occupants and the like in a front view, and the outlet 26 and the first inlet 27 do not enter the visual field of the occupants and the like. In addition, no seams appear on the surface of the front panel 24*a*, excepting the seam extending in the horizontal direction formed by the upper edge of the first panel 241 and the lower edge of the second panel 242. Furthermore, the first panel 241 is parallel to the vertical direction, and the second panel 242 is also parallel to the vertical direction. Consequently, in a state wherein the outlet 26 and the first inlet 27 are closed, the front panel 24*a* forms a flat surface 243 parallel to the vertical direction.

<Operation of the Indoor Unit>

The following explains operation for the case in which the indoor unit 2*a* of the air conditioner 1 performs air conditioning operation.

If the indoor unit 2*a* is stopped, then the front panel 24*a* is in a state wherein the outlet 26 and the first inlet 27 are closed, as described above.

If the indoor unit 2*a* is in operation, first, the indoor fan 21 is started at low speed.

Next, the front panel 24*a* moves, and the outlet 26 and the first inlet 27 open. Thereby, the volume of air taken into the indoor unit 2*a* is ensured, and air is blown out in the horizontal direction. In this case, as depicted in FIG. 3(*b*), the second panel 242 moves frontward in parallel. Thereby, the first inlet 27 opens. In addition, the first panel 241 moves vertically upward, linked to the movement of this second panel 242. Further, part of the upper side of the first panel 241 is inserted between the second panel 242 and the casing main body 23. Thereby, the outlet 26 opens.

After the front panel 24*a* moves and the outlet 26 and the first inlet 27 are opened, the horizontal flap 29 rotatably moves so that it forms a blow out angle corresponding to the operation mode that was set.

Thus, the indoor unit 2*a* operates as described above.

If operation of the indoor unit 2*a* stops, then the front panel 24*a* moves, and returns to a state wherein the outlet 26 and the first inlet 27 are closed, as depicted in FIG. 2(*a*) and FIG. 2(*b*).

<Features>

<1>

With the indoor unit 2*a* of this air conditioner 1, the front panel 24*a* when operation is stopped covers the entire front surface of the indoor unit 2*a*. Furthermore, the front panel 24*a* forms the flat surface 243 parallel to the vertical direction. Consequently, when operation of the indoor unit 2*a* is stopped, only the flat front panel 24*a* in a front view appears in the visual field of the occupants and the like. In addition, only the seam extending in the transverse direction (the horizontal direction), which is the boundary between the first panel 241 and the second panel 242, appears in the surface of the front panel 24*a*, and no other seams appear. Accordingly, with this indoor unit 2*a*, in a front view, the seam extending in the longitudinal direction (the vertical direction) does not appear, and the seam extending in the transverse direction is also minimized. Consequently, with the indoor unit 2*a* of this air conditioner 1, the external appearance of the indoor unit 2*a* when operation is stopped in a front view harmonizes with the wall surfaces of the room, thereby enhancing aesthetics.

<2>

Because a wall mounted indoor unit is generally disposed on a wall surface of a room, the front portion tends to enter the visual field of the occupants and the like. In addition, the surface area of the front portion of the indoor unit is relatively large. Consequently, the present invention, which improves aesthetics in a front view when operation is stopped, is particularly effective.

<3>

With the indoor unit 2*a* of this air conditioner 1, the movement of the first panel 241 and the second panel 242 during operation opens the outlet 26 and the first inlet 27. Consequently, air can be sufficiently sucked into the indoor unit 2*a* and be sufficiently blown out from the indoor unit 2*a*.

In addition, when the outlet 26 and the first inlet 27 open, the first panel 241 should move vertically, and the second panel 242 should move slightly frontward. Consequently, there is little increase of a depth D of the indoor unit 2*a* during operation (refer to FIG. 3(*b*)). Consequently, with the indoor unit 2*a* of this air conditioner 1, the indoor unit 2*a* can be compactly constituted during operation.

<4>

With the indoor unit 2*a* of this air conditioner 1, the indoor fan 21 is started at low speed before the front panel 24*a* opens. In this case, because the indoor fan 21 rotates in a state wherein the front panel 24*a* is closed, the air in the interior of the indoor unit 2*a* is agitated. Thereby, the smell confined to the interior of the indoor unit 2*a* is absorbed in the moisture condensed in the indoor heat exchanger 20 during cooling operation. Accordingly, odors that leak into the room can be reduced. In addition, by leaving the front panel 24*a* closed until the temperature of the indoor heat exchanger 20 rises during heating, the feeling of drafts during operation initialization can be reduced.

Second Embodiment

Figure 4:
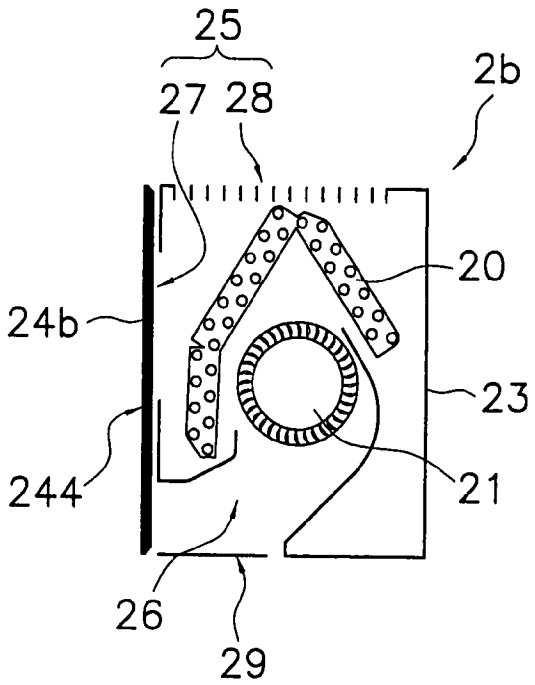
FIG. 4(*a*) is a front view of the indoor unit when operation is stopped according to the second embodiment.
Figure 4:
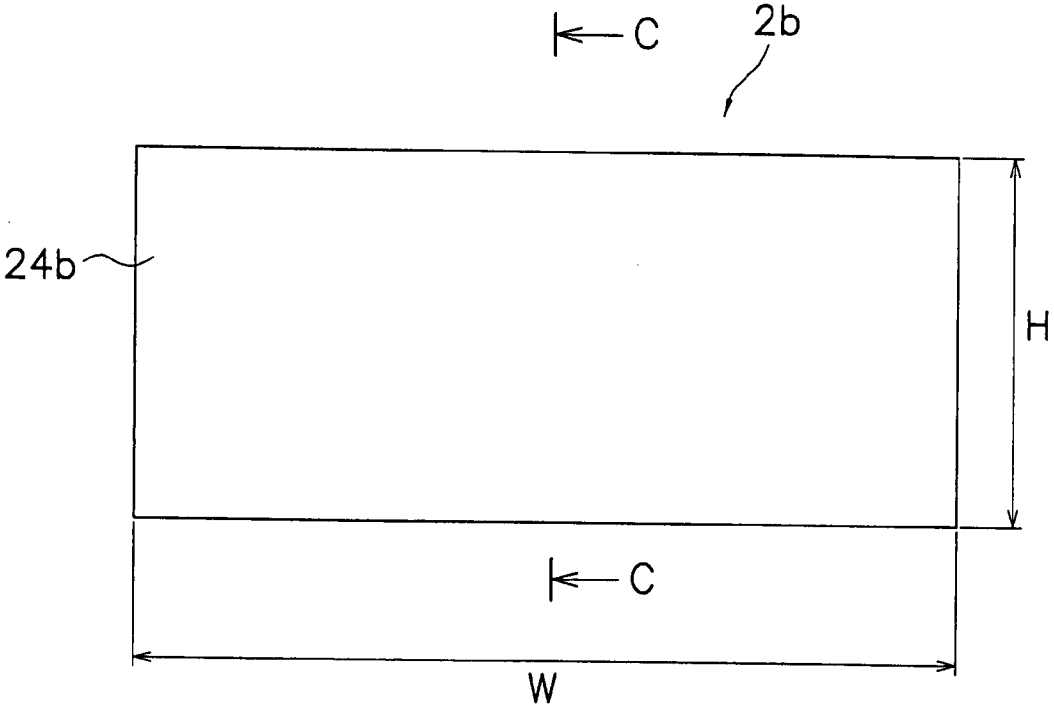

FIG. 4(*a*) and FIG. 4(*b*) depict an indoor unit 2*b* of the air conditioner 1 according to the second embodiment of the present invention. FIG. 4(*a*) is a front view of the indoor unit 2*b* when operation is stopped, and FIG. 4(*b*) is a side cross sectional view of the indoor unit 2*b* when operation is stopped.

This indoor unit 2*b* comprises a front panel 24*b* that covers substantially the entire front surface of the casing main body 23. This front panel 24*b* is a single, flat plate shaped member having no seams in a front view, and forms a flat surface 244 parallel to the vertical direction in a state wherein the outlet 26 and the first inlet 27 are closed. In addition, the front panel 24*b* has a long rectangular shape in the horizontal direction in a front view, and has a width substantially the same as the width W of the casing main body 23, including the outlet 26 and the first inlet 27 in a front view. The front panel 24*b* opens and closes the outlet 26 and the first inlet 27, and covers the outlet 26 and the first inlet 27 in a front view in a state wherein the outlet 26 and the first inlet 27 are closed.

Figure 5:
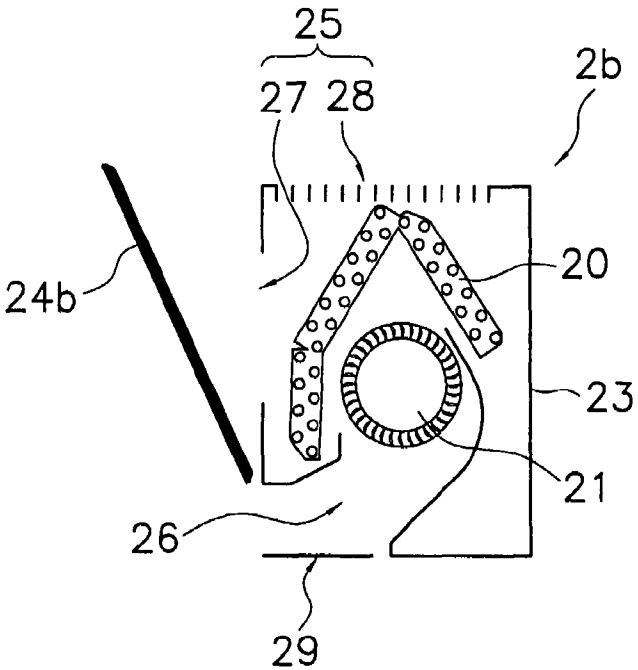
FIG. 5(*a*) is a front view during operation of the indoor unit according to the second embodiment.
Figure 5:
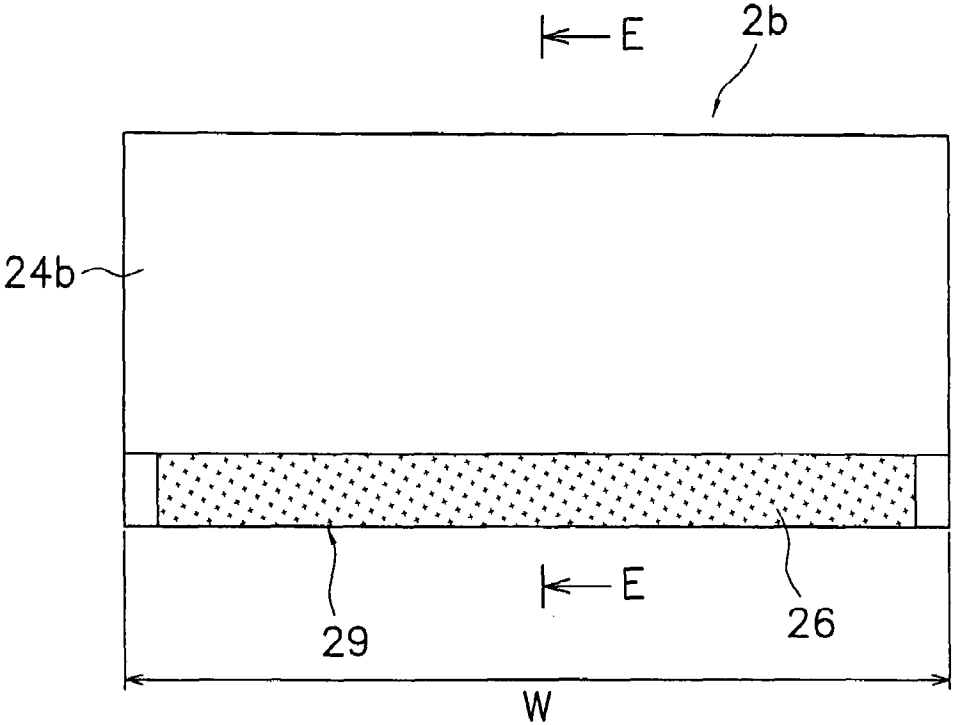

The following explains the operation of the indoor unit 2*b* during operation. FIG. 5(*a*) depicts a front view of the indoor unit 2*b* during operation, and FIG. 5(*b*) is a side cross sectional view of the indoor unit 2*b* during operation.

When the indoor unit 2*b* starts operation, the front panel 24*b* moves, and opens the outlet 26 and the first inlet 27. The front panel 24*b* moves vertically upward, and its upper end rotatably moves about the lower end in a direction away from the casing main body 23. Thus, the movement of the front panel 24*b* upward opens the outlet 26, and the rotational movement of the front panel 24*b* opens the first inlet 27.

Other aspects of the constitution and operation are the same as the indoor unit 2*a* according to the first embodiment.

<Features>

With the indoor unit 2*b* of this air conditioner 1, a single, seamless front panel 24*b* covers both the inlet 25 and the outlet 26. Consequently, a seam does not appear in a front view of the indoor unit 2*b*. In addition, the flat surface 244 formed by the front panel 24*b* gives the occupants and the like a feeling of simplicity. Thereby, with the indoor unit 2*b* of this air conditioner 1, the external appearance of the indoor unit 2*b* when operation is stopped in a front view harmonizes with the wall surfaces of the room, and thereby enhances aesthetics.

Third Embodiment

Figure 6:
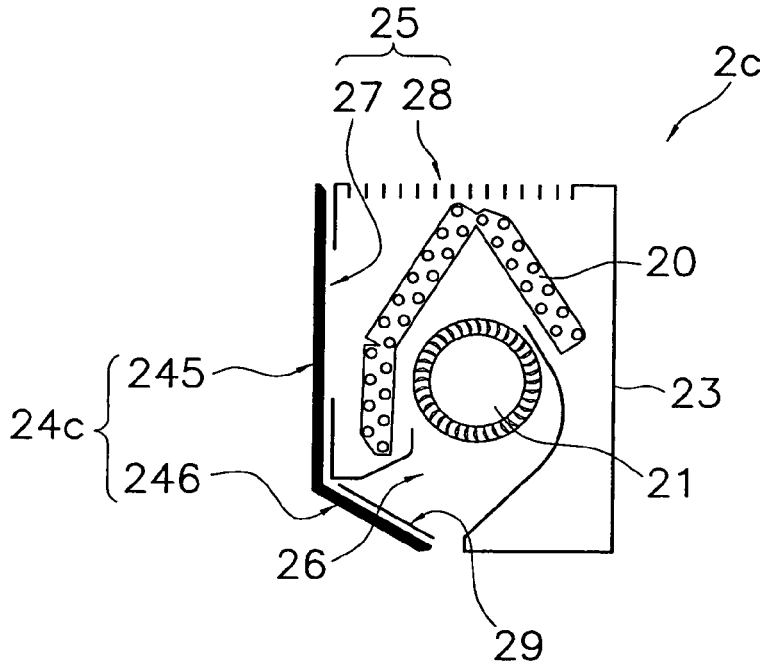
FIG. 6(*a*) is a side cross sectional view of the indoor unit when operation is stopped according to the third embodiment.
Figure 6:
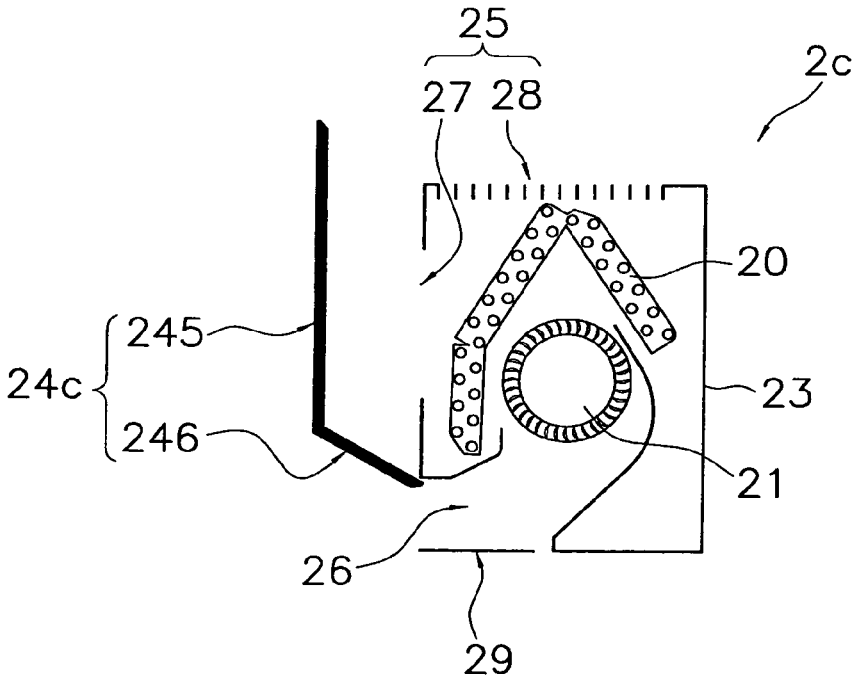

FIG. 6(*a*) and FIG. 6(*b*) depict an indoor unit 2*c* of the air conditioner 1 according to the third embodiment of the present invention. FIG. 6(*a*) is a side cross sectional view of the indoor unit 2*c* when operation is stopped, and FIG. 6(*b*) is a side cross sectional view of the indoor unit 2*c* during operation.

This indoor unit 2*c* comprises a front panel 24*c* that covers the entire front surface of the indoor unit 2*c*. The front panel 24*c* opens and closes the outlet 26 and the first inlet 27. In a state wherein the outlet 26 and the first inlet 27 are closed, the front panel 24*c* covers the outlet 26 and the first inlet 27 in a front view. This front panel 24*c* is a plate shaped member having no seams in a front view, and comprises a first flat surface part 245 and a second flat surface part 246. The first flat surface part 245 and the second flat surface part 246 are both flat plate shaped. The first flat surface part 245 is parallel to the vertical direction, and closes the first inlet 27. The second flat surface part 246 is disposed inclined along the shape of the exit of the outlet 26, and closes the outlet 26. The upper end of the second flat surface part 246 is joined to the lower end of the first flat surface part 245 at a prescribed angle. The first flat surface part 245 and the second flat surface part 246 are seamlessly integrated. In addition, the first flat surface part 245 and the second flat surface part 246 respectively have long rectangular shapes in the horizontal direction, and have widths substantially the same as the width W of the casing main body 23.

The following explains the operation of the indoor unit 2*c* during operation.

When the indoor unit 2*c* starts operation, the front panel 24*c* moves, and opens the outlet 26 and the first inlet 27. At this time, the front panel 24*c* moves frontward in an inclined upward direction. Furthermore, the front panel 24*c* may also move directly in a frontward inclined upward direction, and may also move by combining the frontward parallel movement and the upward movement. The movement of the front panel 24*c* moves the first flat surface part 245 away from the first inlet 27, and opens the first inlet 27. In addition, the second flat surface part 246 moves away from the outlet 26, and opens the outlet 26.

Other aspects of the constitution are the same as the indoor unit 2*a* according to the first embodiment.

<Features>

With the indoor unit 2*c* of this air conditioner 1, a seamless single front panel 24*c* covers both the inlet 25 and the outlet 26 when operation is stopped. Consequently, when operation of the indoor unit 2*c* is stopped, seams do not appear in the indoor unit 2*c* in a front view. In addition, the second flat surface part 246 of the front panel 24*c* is formed along the outlet 26. Consequently, even if the side surface shape of the casing main body 23 is not rectangular and instead the exit of the outlet 26 is shaped inclined, the front surface of the indoor unit 2*c* can be covered by a seamless, flat and smooth front panel 24*c*. Thereby, with the indoor unit 2*c* of this air conditioner 1, the external appearance of the indoor unit 2*c* in a front view when operation is stopped harmonizes with the wall surfaces of the room, thereby improving aesthetics.

Fourth Embodiment

Constitution

Figure 7B:
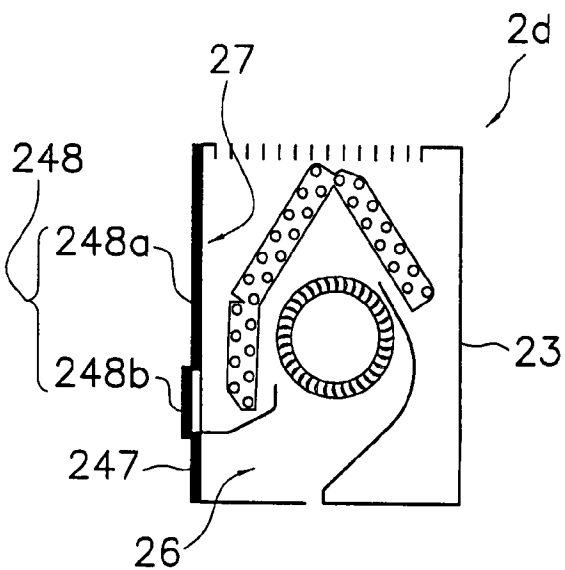
FIG. 7(*a*) is a front view of the indoor unit when operation is stopped according to the fourth embodiment.
Figure 7A:
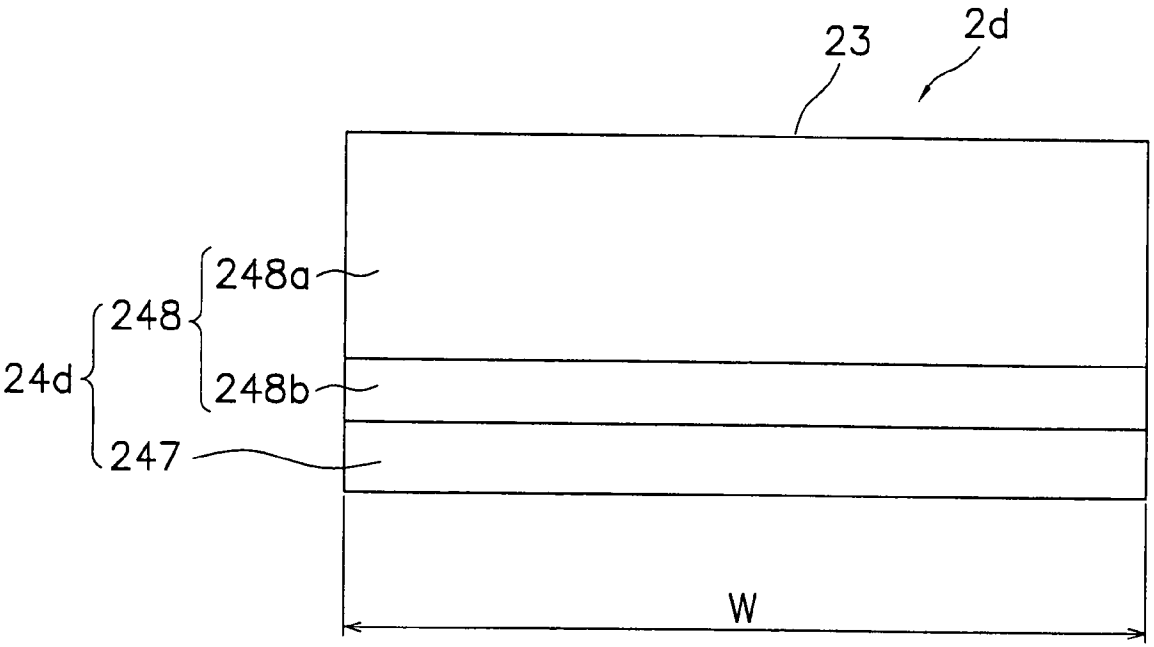
Figure 8:
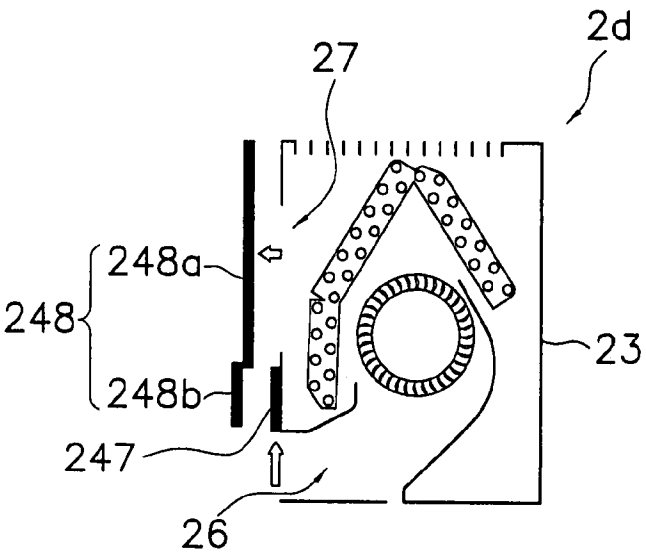
FIG. 8(*a*) is a front view during operation of the indoor unit according to the fourth embodiment.
Figure 8:
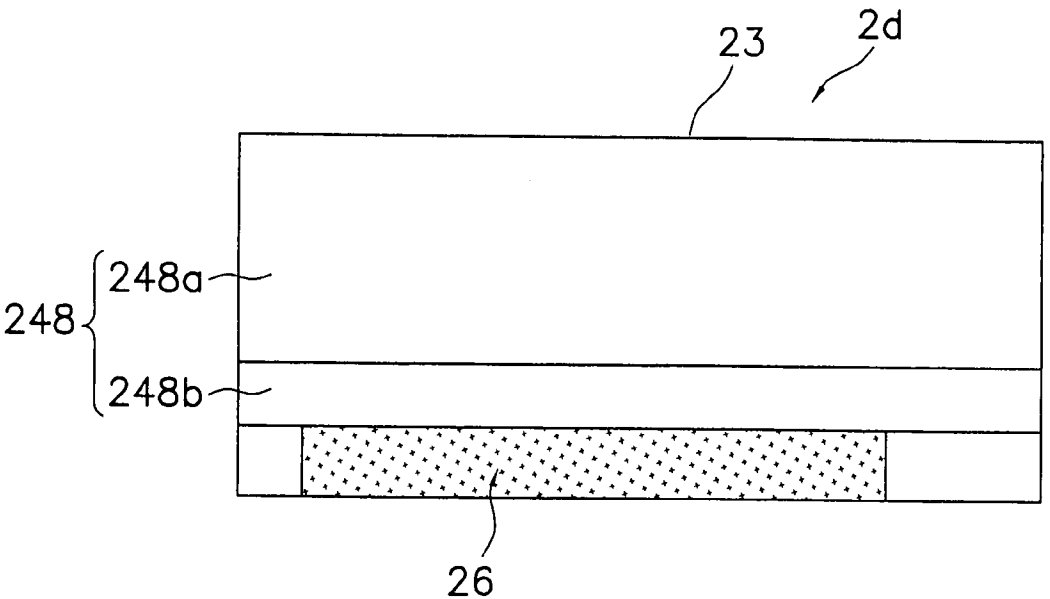

FIG. 7(*a*), FIG. 7(*b*), FIG. 8(*a*) and FIG. 8(*b*) depict an indoor unit 2*d* of the air conditioner 1 according to the fourth embodiment of the present invention. FIG. 7(*a*) is a front view of the indoor unit 2*d* when operation is stopped, and FIG. 7(*b*) is a side cross sectional view of the indoor unit 2*d* when operation is stopped. In addition, FIG. 8(*a*) is a front view of the indoor unit 2*d* during operation, and FIG. 8(*b*) is a side cross sectional view of the indoor unit 2*d* during operation.

The indoor unit 2*d* comprises a front panel 24*d* that covers substantially the entire front surface of the casing main body 23. The front panel 24*d* is a panel assembly that aggregates a plurality of seamless panels, and comprises a first panel 247 and a second panel 248.

The first panel 247 is disposed at the lower part of the front surface of the casing main body 23. The first panel 247 is movably supported by the moving mechanism (not shown), and opens and closes the outlet 26. The first panel 247 is a seamless, rectangular, plate shaped member, and has a width substantially the same as the width W of the casing main body 23 in a front view. In a state wherein the outlet 26 is closed, the first panel 247 is in a state parallel to the vertical direction, as depicted in FIG. 7(*b*). In addition, in this state, the first panel 247 has a projection area larger than the outlet 26 in a front view. Accordingly, in a state wherein the outlet 26 is closed, the first panel 247 completely covers the lower part of the front surface of the casing main body 23, including the outlet 26.

The second panel 248 is disposed at the upper part of the front surface of the casing main body 23. The second panel 248 is movably supported by the moving mechanism (not shown), and opens and closes the first inlet 27. The second panel 248 comprises a first part 248*a* and a second part 248*b*. The first part 248*a* and the second part 248*b* are respectively seamless, rectangular, plate shaped members, and have widths substantially the same as the width W of the casing main body 23, including the first inlet 27, in a front view. In a state wherein the first inlet 27 is closed, the first part 248*a* and the second part 248*b* are in a state parallel to the vertical direction, as depicted in FIG. 7(*b*). The second part 248*b* is positioned at the lower part of the first part 248*a*, and protrudes frontward from the first part 248*a*. In addition, in this state, the second part 248*b* is positioned at the upper part of the first panel 247. Further, the lower end of the second part 248*b* is positioned frontward of the upper end of the first panel 247, and is positioned so that it overlaps the upper end of the first panel 247. In addition, the second panel 248 has a projection area larger than the first inlet 27 in a front view. Accordingly, in a state wherein the first inlet 27 is closed, the second panel 248 completely covers the upper half of the front surface of the casing main body 23 including the first inlet 27.

Thus, in a state wherein the outlet 26 is closed, the first panel 247 completely covers the lower part of the front surface of the casing main body 23, including the outlet 26; and in a state wherein the first inlet 27 is closed, the second panel 248 completely covers the upper part of the front surface of the casing main body 23, including the first inlet 27. In addition, the first panel 247 and the second panel 248 are arrayed vertically, and part of the lower end of the second panel 248 overlaps the upper end of the first panel 247.

Other aspects of the constitution and the operation of the indoor unit 2*d* are the same as the indoor unit 2*a* according to the first embodiment.

<Features>

With the indoor unit 2*d* of this air conditioner 1, in a state wherein the outlet 26 and the first inlet 27 are closed by the front panel 24*d*, part of the lower end of the second panel 248 overlaps the upper end of the first panel 247. Consequently, it is difficult to see, in a front view, the gap between the first panel 247 and the second panel 248. Thereby, with the indoor unit 2*d* of this air conditioner 1, the external appearance of the indoor unit 2*d* when operation is stopped in a front view further harmonizes with the wall surfaces of the room, and thereby further enhances aesthetics.

Fifth Embodiment

Constitution

Figure 12:
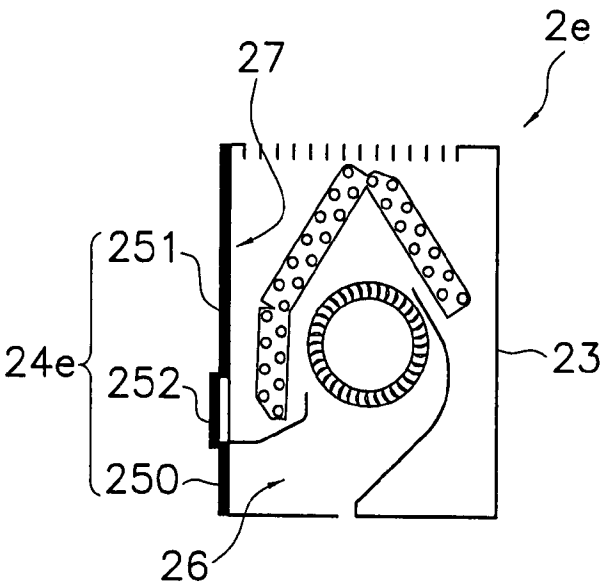
FIG. 12(*a*) is a front view of the indoor unit when operation is stopped according to the fifth embodiment.
Figure 12:
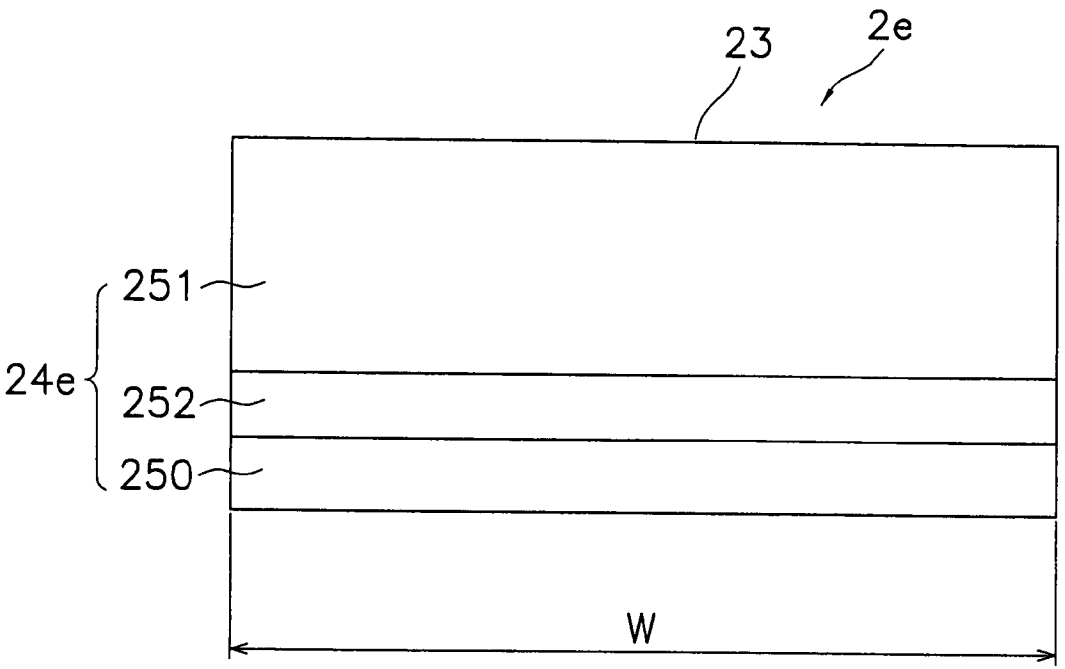

FIG. 12(*a*) and FIG. 12(*b*) depict an indoor unit 2*e* of the air conditioner 1 according to the fifth embodiment of the present invention. FIG. 12(*a*) is a front view of the indoor unit 2*e* when operation is stopped, and FIG. 12(*b*) is a side cross sectional view of the indoor unit 2*e* when operation is stopped.

This indoor unit 2*e* comprises a front panel 24*e* that covers substantially the entire surface of the casing main body 23. The front panel 24*e* is a panel assembly that aggregates a plurality of seamless panels 250-251, and comprises the first panel 250, the second panel 251, and a third panel 252.

The first panel 250 is disposed at the lower part of the front surface of the casing main body 23. The first panel 250 is supported capable of being moved by the moving mechanism (not shown) parallel to the vertical direction, and opens and closes the outlet 26. The first panel 250 is a seamless, rectangular plate shaped member, and has a width substantially the same as the width W of the casing main body 23 in a front view. In a state wherein the outlet 26 is closed, the first panel 250 is in a state parallel to the vertical direction, as depicted in FIG. 12(*b*). In addition, in this state, the first panel 250 has a projection area larger than the outlet 26 in a front view. Accordingly, in a state wherein the outlet 26 is closed, the first panel 250 completely covers the lower part of the front surface of the casing main body 23, including the outlet 26.

The second panel 251 is disposed at the upper part of the front surface of the casing main body 23. The second panel 251 is movably supported by the moving mechanism (not shown), and opens and closes the first inlet 27. The second panel 251 is a seamless, rectangular plate shaped member, and has a width substantially the same as the width W of the casing main body 23, including the first inlet 27, in a front view. In a state wherein the first inlet 27 is closed, the second panel 251 is in a state parallel to the vertical direction, as depicted in FIG. 12(*b*). In addition, the second panel 251 has a projection area larger than the first inlet 27 in a front view. Accordingly, in a state wherein the first inlet 27 is closed, the second panel 251 completely covers the upper half of the front surface of the casing main body 23, including the first inlet 27.

The third panel 252 is disposed between the first panel 250 and the second panel 251. The third panel 252 has a seamless, rectangular shape in a front view. The third panel 252 has a width W substantially the same as the indoor unit 2*e*, and has a length substantially the same as the first panel 250 in the vertical direction. The vicinities of the left and right end parts of the third panel 252 are respectively fixed to the left and right side surfaces of the casing main body 23, and the third panel 252 is arranged so that the front surface portion of the third panel 252 is spaced apart from the casing main body 23 in the forward-rear direction. Namely, a gap is formed between the casing main body 23 and the rear part of the third panel 252. This gap is formed slightly larger than the thickness of the first panel 250 disposed below, and forms a space that houses the first panel 250 that moves for the purpose of opening the outlet 26.

Thus, in a state wherein the outlet 26 is closed, the first panel 250 completely covers the lower part of the front surface of the casing main body 23, including the outlet 26; and in a state wherein the first inlet 27 is closed, the second panel 251 completely covers the upper part of the front surface of the casing main body 23, including the first inlet 27. In addition, the first panel 250, the second panel 251, and the third panel 252 are arrayed vertically and, in a state wherein the outlet 26 and the first inlet 27 are closed, are disposed so that they constitute a substantially flat, rectangular flat surface. The front panel 24*e*, comprising the first panel 250, the second panel 251, and the third panel 252, substantially covers the front surface of the indoor unit 2*e* in a state wherein the outlet 26 and the first inlet 27 are closed, and only the seams formed by the boundaries of the first panel 250, the second panel 251, and the third panel 252 appear in a front view. Namely, only the seams extending in the horizontal direction formed by the boundary between the first panel 250 and the third panel 252 and the boundary between the second panel 251 and the third panel 252 appear in the front view.

Other aspects of the constitution are the same as the indoor unit 2*a* according to the first embodiment.

<Operation of the Front Panel at the Start of Operation>

When the indoor unit 2*e* starts operation, the first panel 250 and the second panel 251 move, thereby opening the outlet 26 and the first inlet 27. The following explains the operation of the front panel 24*e*, referencing FIG. 13(*a*), FIG. 13(*b*), and FIG. 13(*c*). Furthermore, FIG. 13(*a*), FIG. 13(*b*), and FIG. 13(*c*) are side views of the indoor unit 2*e*.

Figure 13C:
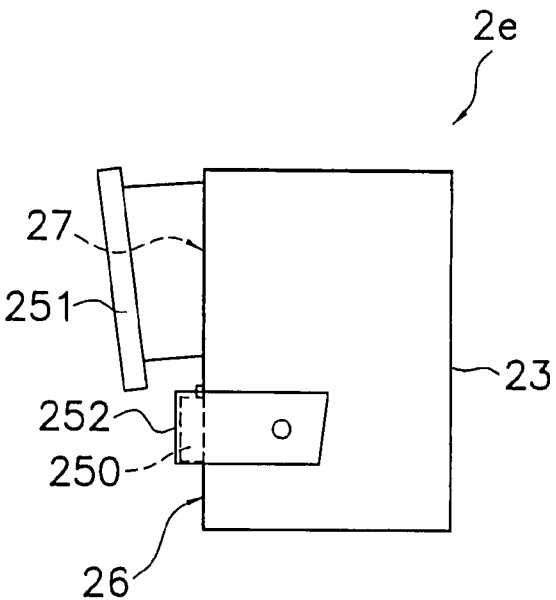
FIG. 13 depicts the operation of the front panel at the start of operation of the indoor unit according to the fifth embodiment.
Figure 13B:
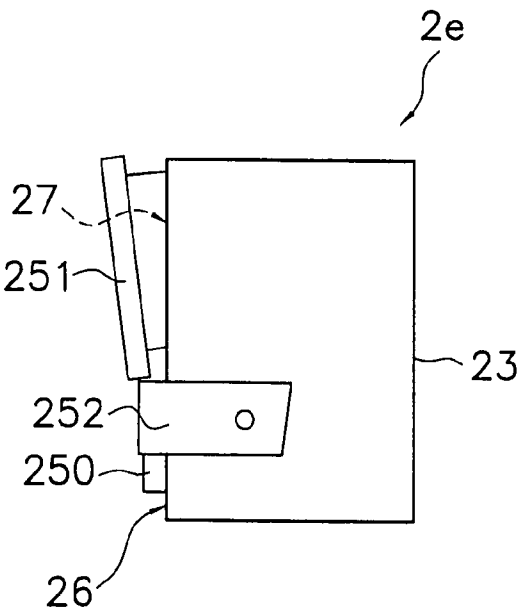
Figure 13A:
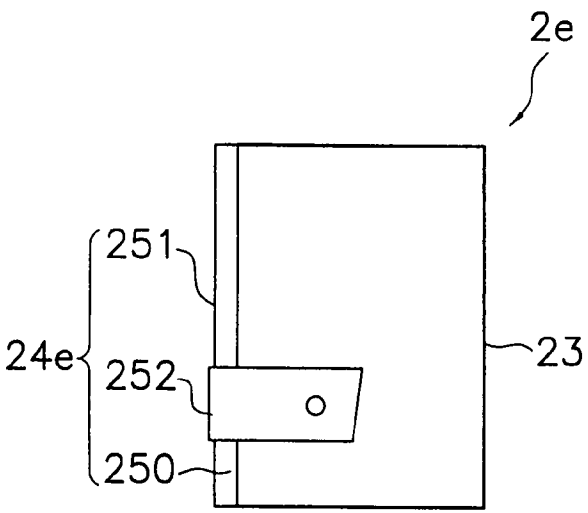

In a state wherein the operation of the indoor unit 2*e* is stopped, the first panel 250 and the second panel 251 close the outlet 26 and the first inlet 27, and, as depicted in FIG. 13(*a*), the first panel 250, the second panel 251, and the third panel 252 are arrayed substantially linearly in a side view parallel to the vertical direction. In addition, the surface of the first panel 250, the second panel 251, and the third panel 252 is substantially flat.

When operation of the indoor unit 2*e* starts, the first panel 250 and the second panel 251 move, thereby opening the outlet 26 and the first inlet 27.

As depicted in FIG. 13(*b*), the first panel 250 moves in parallel upward in the vertical direction, thereby opening the outlet 26. When the first panel 250 moves upward in the vertical direction, the upper end of the first panel 250 enters the gap of the rear part of the third panel 252. When the first panel 250 moves further upward, the first panel 250 is housed in the gap between the third panel 252 and the casing main body 23, as depicted in FIG. 13(*c*), and enters a state wherein it is hidden behind the third panel 252. Namely, the substantial entirety of the first panel 250 enters a state wherein it is overlapped by the third panel 252.

The second panel 251 also moves linked to such movement of the first panel 250. As depicted in FIG. 13(*b*), the second panel 251 moves frontward, and rotates about an axis parallel to the lateral direction, in a front view. The second panel 251 rotates about the vicinity of the lower end thereof as the center, so that its upper end is inclined frontward. The second panel 251 moves further, as depicted in FIG. 13(*c*), and forms a gap between the casing main body 23 and the second panel 251. Thereby, the first inlet 27 opens. Further, air is sucked in from the gap between the upper end of the second panel 251 and the casing main body 23, and air is sucked in from the first inlet 27 into the casing main body 23.

In addition, when operation of the indoor unit 2*e* is stopped, the first panel 250 and the second panel 251 move in the reverse direction of that described above, thereby returning to a flat state.

<Features>

<1>

With the indoor unit 2*e* of this air conditioner 1, the substantial entirety of the front surface when operation is stopped is covered by the front panel 24*e*. The first panel 250, the second panel 251, and the third panel 252 that constitute the front panel 24*e* are disposed so that they form a substantially flat surface when operation of the indoor unit 2*e* is stopped, which minimizes the seams appearing on the surface. Consequently, when operation of the indoor unit 2*e* is stopped, the indoor unit 2*e* better harmonizes with the wall surfaces of the room, thereby enhancing aesthetics.

<2>

With the indoor unit 2*e* of this air conditioner 1, the movement of the first panel 250 and the second panel 251 at the start of operation as described above opens the first inlet 27 and the outlet 26. Thereby, a sufficient air intake and blow out air volume can be ensured. In addition, air can also be sufficiently blown out in the horizontal direction.

Furthermore, in a state wherein the outlet 26 is open, the first panel 250 moves to the rear part of the third panel 252, and enters a state wherein it is hidden by the third panel 252. Consequently, the first panel 250 does not hinder the inlet or blow out of air during operation, and the aesthetics in a front view is enhanced.

Sixth Embodiment

Constitution

Figure 14A:
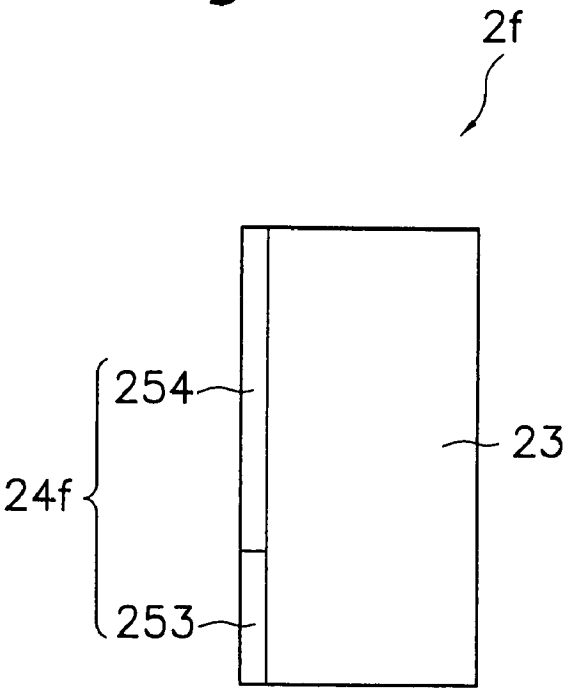
FIG. 14 depicts the operation of the front panel at the start of operation of the indoor unit according to the sixth embodiment.
Figure 14B:
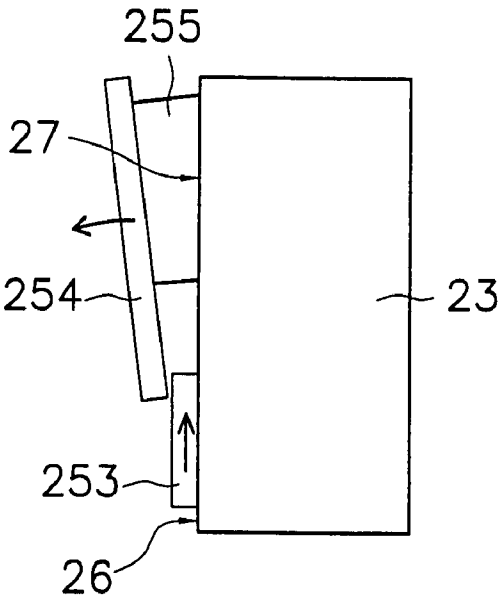
Figure 14C:
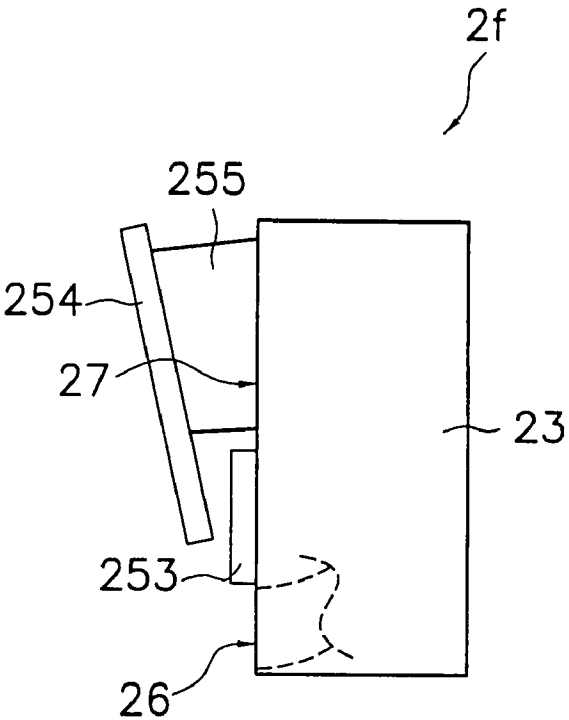

FIG. 14(*a*) to FIG. 14(*c*) depict an indoor unit 2*f* of the air conditioner 1 according to the sixth embodiment of the present invention. Furthermore, FIG. 14(*a*) to FIG. 14(*c*) are side views of the indoor unit 2*f* of the air conditioner 1.

This indoor unit 2*f* comprises a front panel 24*f* that covers the substantial entirety of the front surface of the casing main body 23. The front panel 24*f* is a panel assembly that aggregates two seamless panels 253, 254, and comprises the first panel 253 and the second panel 254.

The first panel 253 is disposed at the lower part of the front surface of the casing main body 23. The first panel 253 is supported capable of being moved by a moving mechanism (not shown) parallel to the vertical direction, and opens and closes the outlet 26. The first panel 253 is a seamless, rectangular plate shaped member, and has a width substantially the same as the width W (refer to FIG. 2(*a*)) of the casing main body 23 in a front view. In a state wherein the outlet 26 is closed, the first panel 253 is in a state parallel to the vertical direction, as depicted in FIG. 14(*a*). In addition, in this state, the first panel 253 has a projection area larger than the outlet 26 in a front view. Accordingly, in a state wherein the outlet 26 is closed, the first panel 253 completely covers the lower part of the front surface of the casing main body 23 including the outlet 26.

The second panel 254 is disposed at the upper part of the front surface of the casing main body 23. The second panel 254 is movably supported by a moving mechanism 255, and opens and closes the first inlet 27. Furthermore, the moving mechanism 255 supports the end portions on both sides of the second panel 254. The second panel 254 is a seamless, rectangular plate shaped member, and has a width substantially the same as the width W (refer to FIG. 2(*a*)) of the casing main body 23, including the first inlet 27 in a front view. In a state wherein the first inlet 27 is closed, the second panel 254 is in a state parallel to the vertical direction, as depicted in FIG. 14(*a*). In addition, the second panel 254 has a projection area larger than the first inlet 27 in a front view. Accordingly, in a state wherein the first inlet 27 is closed, the second panel 254 completely covers the upper half of the front surface of the casing main body 23, including the first inlet 27.

Thus, in a state wherein the outlet 26 is closed, the first panel 253 completely covers the lower part of the front surface of the casing main body 23, including the outlet 26; and in a state wherein the first inlet 27 is closed, the second panel 254 completely covers the upper part of the front surface of the casing main body 23, including the first inlet 27. In addition, the first panel 253 and the second panel 254 are arrayed vertically, and are disposed so that they constitute a substantially flat, rectangular flat surface in a state wherein the outlet 26 and the first inlet 27 are closed. The front panel 24*f* comprising the first panel 253 and the second panel 254 covers the substantial entirety of the front surface of the indoor unit 2*f* in a state wherein the outlet 26 and the first inlet 27 are closed, and only the seam formed by the boundary between the first panel 253 and the second panel 254 appears in a front view. Namely, with the front panel 24*f*, only the seam extending in the horizontal direction formed by the boundary between the first panel 253 and the second panel 254 appears in a front view, the same as the front panel 24*a* according to the first embodiment.

Other aspects of the constitution are the same as the indoor unit 2*a* according to the first embodiment.

<Operation of the Front Panel at the Start of Operation>

When the indoor unit 2*f* starts operation, the first panel 253 and the second panel 254 move, thereby opening the outlet 26 and the first inlet 27. The following explains the operation of the front panel 24*f*.

In a state wherein the operation of the indoor unit 2*f* is stopped, the first panel 253 and the second panel 254 close the outlet 26 and the first inlet 27, and, as depicted in FIG. 14(*a*), the first panel 253 and the second panel 254 are arrayed substantially linearly, in a side view, parallel to the vertical direction. In addition, the surface of the first panel 253 and the second panel 254 is substantially flat.

When operation of the indoor unit 2*f* starts, the first panel 253 and the second panel 254 move, thereby opening the outlet 26 and the first inlet 27.

As depicted in FIG. 14(*b*), the second panel 254 moves frontward away from the first inlet 27, and rotates about an axis parallel to the lateral direction in a front view. The second panel 254 rotates about the vicinity of the lower end thereof as the center, so that its upper end is inclined frontward. The second panel 254, as depicted in FIG. 14(*c*), further moves, thereby forming a gap between the casing main body 23 and the second panel 254. Thereby, the first inlet 27 opens. Furthermore, air is sucked in from the gap between the upper end of the second panel 254 and the casing main body 23, and air is sucked in from the first inlet 27 into the casing main body 23. Furthermore, in a state wherein the first inlet 27 is open, the upper end of the second panel 254 is in a state inclined forward, and the upper end of the second panel 254 is in a state inclined rearward. In addition, in this state, the second panel 254 is disposed so that it does not interfere with the outlet 26. Namely, the lower end of the second panel 254 is positioned upward of the outlet 26, so that it does not become an obstacle to the blow out of air from the outlet 26.

The first panel 253 also moves linked to such movement of the second panel 254. As depicted in FIG. 14(*b*), the first panel 253 moves in parallel upward in the vertical direction, and opens the outlet 26. When the first panel 253 moves upward in the vertical direction, the upper end of the first panel 253 is inserted between the second panel 254, which has moved frontward, and the front surface of the casing main body 23. Namely, the upper end of the first panel 253 is inserted in the gap at the rear part of the second panel 254. When the first panel 253 moves further upward, the first panel 253 is housed in the gap between the second panel 254 and the casing main body 23, as shown in FIG. 14(*c*). Namely, the entirety or part of the first panel 253 enters a state wherein it is overlapped by the second panel 254. Furthermore, the first panel 253 moves in a state proximate to the front surface of the casing main body 23. From the viewpoint of preventing damage due to friction, it is preferable that the first panel 253 and the casing main body 23 do not make contact during the movement of the first panel 253, and it is further preferable that the first panel 253 and the casing main body 23 are spaced apart by approximately 1 mm or 2 mm.

In addition, when operation of the indoor unit 2*f* is stopped, the first panel 253 and the second panel 254 return to a flat state by moving in the reverse direction of that described above.

<Features>

The indoor unit 2*f* of this air conditioner 1 can also achieve the effect of enhancing aesthetics, the same as the indoor units 2*a*-2*e* according to the abovementioned embodiments.

In addition, the movement of the second panel 254 so that it is inclined makes it difficult to externally see the inner contents of the indoor unit 2*f* through the first inlet 27. Consequently, the aesthetics can be further enhanced.

Furthermore, when the outlet 26 opens, the first panel 253 approaches the casing main body 23, and it is consequently possible to suppress the leakage, from the gap between the first panel 253 and the casing main body 23, of the air blown out from the outlet 26, thereby suppressing the generation of a short circuit, wherein that air is sucked in once again from the first inlet 27. In addition, when the first panel 253 moves as well as when it is stopped, the proximity of the first panel 253 to the casing main body 23 makes it difficult to externally see the inner contents of the indoor unit 2*f* through the gap between the first panel 253 and the casing main body 23, and through the first inlet 27. Consequently, the aesthetics can be further enhanced.

Other Embodiments

1

With the indoor unit 2*a* according to the abovementioned first embodiment, the second panel 242 moves in parallel frontward, and the first panel 241 moves vertically upward. Further, part of the upper side of the first panel 241 is inserted between the second panel 242 and the casing main body 23. Thereby, the outlet 26 and the first inlet 27 open. However, the movement of the first panel 241 and the second panel 242 during operation is not limited thereto. For example, as described in <A>, <B>, and <C> below, the movement of the first panel 241 and the second panel 242 may open the outlet 26 and the first inlet 27.

<A>

Figure 9:
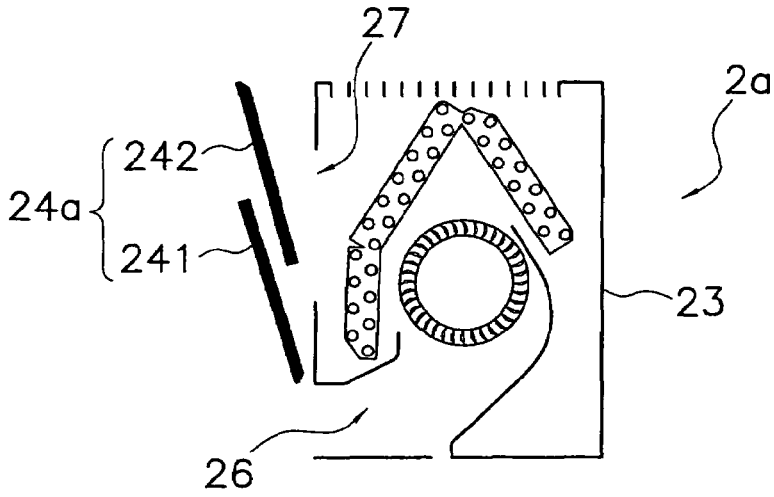
FIG. 9(*a*) is a side cross sectional view during operation of the indoor unit according to another embodiment.
Figure 9:
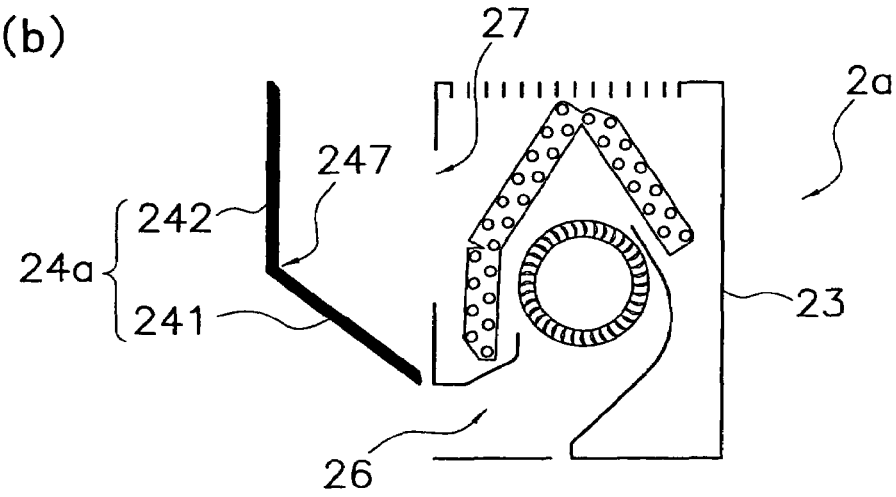
Figure 9:
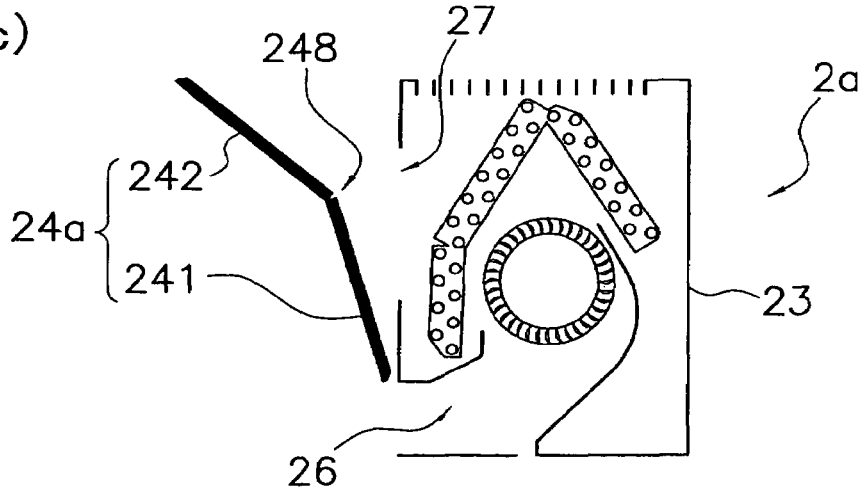

As depicted in FIG. 9(*a*), the first panel 241 moves vertically upward, and the upper end of the first panel 241 moves rotatably about the lower end in a direction away from the casing main body 23. The movement of the first panel 241 vertically upward opens the outlet 26. In addition, attendant with the movement of the first panel 241, the second panel 242 also moves vertically upward, and the upper end of the second panel 242 moves rotatably about the lower end in a direction away from the casing main body 23. The rotational movement of the second panel 242 opens the first inlet 27. Finally, part of the upper side of the first panel 241 and part of the lower side of the second panel 242 enter an overlapped state, thereby opening the outlet 26 and the first inlet 27.

<B>

As depicted in FIG. 9(*b*), the upper end of the first panel 241 and the lower end of the second panel 242 are connected rotatable about the connection part 247. Further, the first panel 241 moves vertically upward, and its upper end rotates about its lower end in a direction away from the casing main body 23. The movement of the first panel 241 vertically upward opens the outlet 26. The second panel 242 moves in parallel frontward while maintaining an orientation parallel to the vertical direction, regardless of the rotational movement of the upper end of the first panel 241. The movement of the second panel 242 in parallel frontward opens the first inlet 27. Finally, the front panel 24*a*, which is in a state bent from the midpoint so that its upper end approaches the casing main body 23, enters a state in which it has moved upward, thereby opening the outlet 26 and the first inlet 27.

<C>

As depicted in FIG. 9(*c*), the upper end of the first panel 241 and the lower end of the second panel 242 are connected rotatable about the connection part 248. Furthermore, the first panel 241 moves vertically upward, and the upper end of the first panel 241 rotates about its lower end in a direction away from the casing main body 23. The movement of the first panel 241 vertically upward opens the outlet 26. Attendant with the rotational movement of the upper end of the first panel 241, the upper end of the second panel 242 moves rotatably about the lower end in a direction away from the casing main body 23. The rotational movement of the upper end of the second panel 242 opens the first inlet 27. Finally, the front panel 24*a*, which is in a state bent midway so that its upper end moves away from the casing main body 23, enters a state wherein it has moved upward, thereby opening the outlet 26 and the first inlet 27.

2

Figure 10:
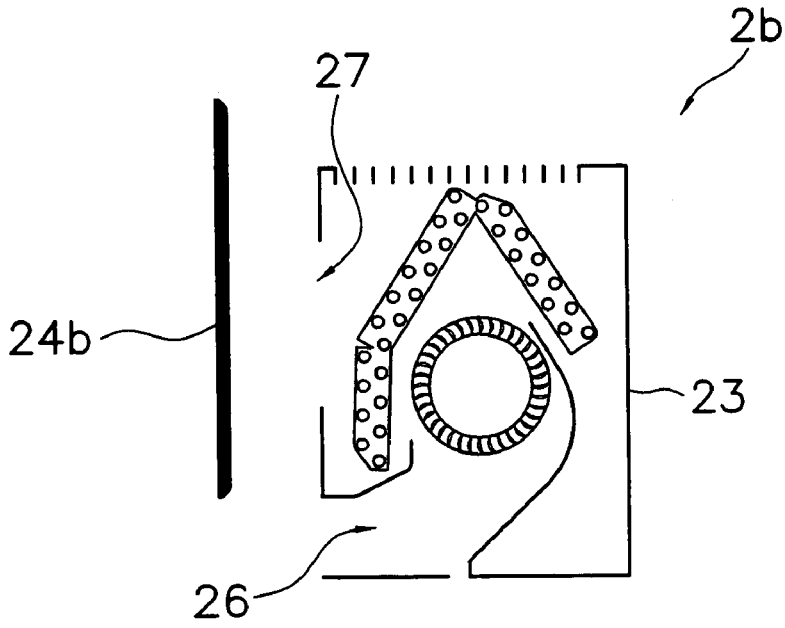
FIG. 10 is a side cross sectional view during operation of the indoor unit according to another embodiment.
Figure 11:
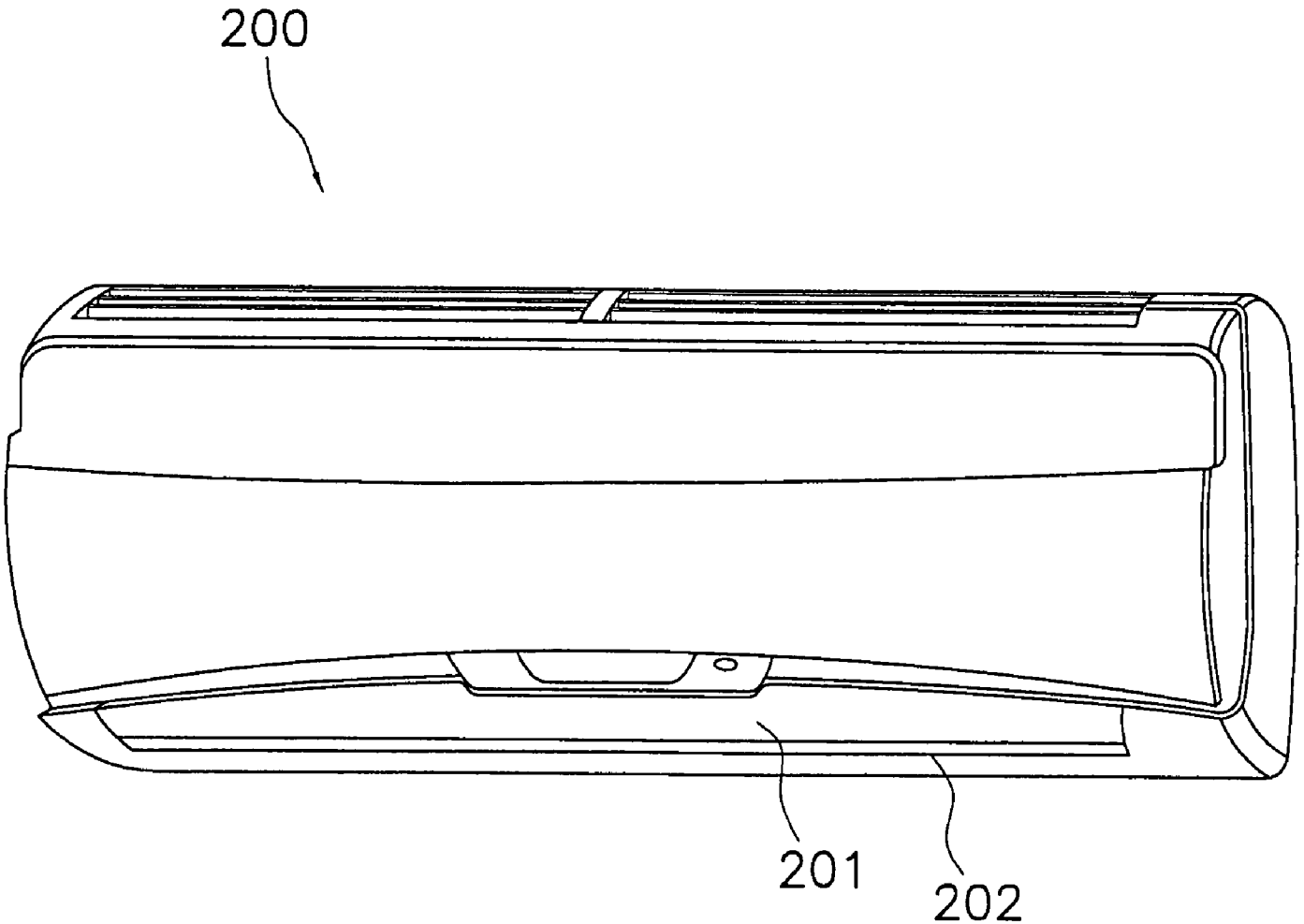
FIG. 11 is a front view of the conventional air conditioner indoor unit.

With the indoor unit 2*b* according to the abovementioned second embodiment, the front panel 24*b* moves vertically upward, and the upper end moves rotatably about the lower end in a direction away from the casing main body 23, but the movement of the front panel 24*b* is not limited thereto. For example, as shown in FIG. 10, the front panel 24*b* may move inclined in the forward upward direction in a state, as is, parallel to the vertical direction, thereby opening the outlet 26 and the first inlet 27.

3

With the indoor unit 2*a* according to the abovementioned first embodiment, the front panel 24*a* comprises the first panel 241 and the second panel 242, but may further comprise an additional plurality of panels. However, the smaller the number of the plurality of panels that constitutes the front panel 24*a*, the fewer the seams that will appear in the front panel 24*a*, and it is consequently preferable that the number of the plurality of panels that constitutes the front panel 24*a* is small. In addition, it is preferable that the plurality of panels that constitutes the front panel 24*a* is arrayed in the longitudinal direction. Thereby, seams extending in the longitudinal direction do not appear in a front view, thereby enhancing aesthetics.

INDUSTRIAL FIELD OF APPLICATION

The present invention achieves the effect of enabling a further reduction in the risk of impairing the aesthetics of a room, and is useful as the indoor unit of an air conditioner.

The invention claimed is:

1. An indoor unit of an air conditioner, comprising:

a casing having an outlet for passing air out into a room;

a front panel configured to cover said outlet as seen in a front surface view of said casing, and arranged to open and close said outlet, said front panel having a projection area greater than said outlet as seen in said front surface view of said casing when said outlet is closed, said casing further including a front surface and an inlet provided in said front surface for passing air taken in from the room; and said front panel including a first panel configured to open and close said outlet, said first panel having a projection area greater than said outlet as seen in said front surface view when said outlet is closed, and a second panel configured to open and close said inlet, said second panel having a projection area greater than said inlet as seen in said front surface view when said inlet is closed.

2. The indoor unit as recited in claim 1, wherein said front panel further includes a third panel disposed between said first panel and said second panel, said third panel having no seams as seen in said front surface view, and said first panel, said second panel, and said third panel being disposed to form a substantially fiat surface when said outlet and said inlet are closed.

3. The indoor unit as recited in claim 1, wherein said front panel has a width substantially the same as a width of said casing as seen in said front surface view of said casing.

4. The indoor unit as recited in claim 3, wherein said first panel does not have a seam, and has a width substantially the same as said width of said casing as seen in said front surface view, and said second panel does not have a seam, and has a width substantially the same as said width of said casing as seen in said front surface view.

5. The indoor unit as recited in claim 3, wherein said front panel further includes a third panel disposed between said first panel and said second panel, said third panel having no seams as seen in said front surface view, and said first panel, said second panel, and said third panel are disposed to form a substantially flat surface when said outlet and said inlet are closed.

6. The indoor unit as recited in claim 5, wherein said first panel is configured and arranged to move so that movement to a rear of said third panel pens said outlet.

7. The indoor unit as recited in claim 3, wherein said second panel is configured and arranged to move so that said second panel is spaced apart from said inlet opens said inlet, and said first panel is configured and arranged to move such that said first panel is between said casing and said second panel to open said outlet.

8. The indoor unit as recited in claim 7, wherein said first panel and said second panel are arrayed vertically on said front surface of said casing, said first panel being disposed on a lower side and said second panel being disposed on an upper side, such that frontward movement of said second panel opens said inlet, and upward movement of said first panel to a rear of said second panel opens said outlet.

9. The indoor unit as recited in claim 8, wherein said second panel is configured and arranged to enter a state where an upper end of said second panel is inclined frontward when said inlet is open.

10. The indoor unit as recited in claim 8, wherein a lower end of said second panel is positioned upward of said outlet, which is positioned below said inlet, when said inlet is open.

11. The indoor unit as recited in claim 7, wherein said first panel moves to a state when said first panel is proximate to said casing when said outlet opens.

12. An indoor unit of an air conditioner, comprising:

a casing having an outlet for passing air out into a room; and a front panel configured to cover said outlet as seen in a front surface view of said casing, and arranged to open and close said outlet, said front panel having a projection area greater than said outlet as seen in said front surface view of said casing when said outlet is closed, said front panel having a width substantially the same as a width of said casing as seen in said front surface view of said casing, said casing further including a front surface and an inlet provided in said front surface for passing air taken in from the room, and said front panel being configured to open and close said outlet and said inlet, said front panel including a seamless member that covers said outlet and said inlet of said casing as seen in said front surface view when said outlet and said inlet are closed.

13. The indoor unit as recited in claim 12, wherein said front panel has a width substantially the same as said width of said casing as seen in said front surface view.

14. An indoor unit of an air conditioner, comprising:

a casing having an outlet for passing air out into a room; and a front panel configured to cover said outlet as seen in a front surface view of said casing, and arranged to open and close said outlet, said front panel having a projection area greater than said outlet as seen in said front surface view of said casing when said outlet is closed, said front panel having a width substantially the same as a width of said casing as seen in said front surface view of said casing, said front panel not having a seam extending in the longitudinal direction in said front surface view, and said front panel covering substantially an entirety of said front surface of said casing as seen in said front surface view when said outlet is closed.

* * * * *

UNITED STATES PATENT AND TRADEMARK OFFICE

CERTIFICATE OF CORRECTION

PATENT NO. : 7,703,294 B2
APPLICATION NO. : 10/549194
DATED : April 27, 2010
INVENTOR(S) : Junji Nakamura It is certified that error appears in the above-identified patent and that said Letters Patent is hereby corrected as shown below:

Column 19,
Line 22, "movement to a rear of said third panel pens said outlet" should read -- movement to a rear of said third panel opens said outlet --.

Signed and Sealed this

Third Day of August, 2010

David J. Kappos

David J. Kappos
*Director of the United States Patent and Trademark Office*